US008165882B2

(12) United States Patent
Kato et al.

(10) Patent No.: US 8,165,882 B2
(45) Date of Patent: Apr. 24, 2012

(54) METHOD, APPARATUS AND PROGRAM FOR SPEECH SYNTHESIS

(75) Inventors: Masanori Kato, Tokyo (JP); Satoshi Tsukada, Tokyo (JP)

(73) Assignee: NEC Corporation, Tokyo (JP)

( * ) Notice: Subject to any disclaimer, the term of this patent is extended or adjusted under 35 U.S.C. 154(b) by 992 days.

(21) Appl. No.: 12/065,985

(22) PCT Filed: Sep. 4, 2006

(86) PCT No.: PCT/JP2006/317432

§ 371 (c)(1),
(2), (4) Date: Mar. 6, 2008

(87) PCT Pub. No.: WO2007/029633

PCT Pub. Date: Mar. 15, 2007

(65) Prior Publication Data

US 2009/0204405 A1 Aug. 13, 2009

(30) Foreign Application Priority Data

Sep. 6, 2005 (JP) ..... 2005-258156

(51) Int. Cl.

| | |
|---|---|
| ***G10L 13/00*** | (2006.01) |
| ***G10L 19/00*** | (2006.01) |
| ***G10L 21/04*** | (2006.01) |
| ***G10L 11/00*** | (2006.01) |
| ***G10L 19/14*** | (2006.01) |

(52) U.S. Cl. ..... 704/268; 704/258; 704/262; 704/265; 704/267; 704/500; 704/503; 704/200; 704/201; 704/205; 704/211

(58) Field of Classification Search ..... 704/258, 704/262, 265, 267, 268, 500, 503, 200, 201, 704/205, 211

See application file for complete search history.

(56) References Cited

U.S. PATENT DOCUMENTS 5,495,432 A * 2/1996 Ho ..... 708/313

(Continued)

FOREIGN PATENT DOCUMENTS

JP 5-281984 10/1993

(Continued)

OTHER PUBLICATIONS

Sanjaume, Jordi Bonada. Audio Time-Scale Modification in the Context of Professional Audio Post-production. Informàtica i Comunicació digital, Universitat Pompeu Fabra Barcelona. Barcelona, Spain, 2002.*

(Continued)

*Primary Examiner* — Paras Shah
(74) *Attorney, Agent, or Firm* — Young & Thompson

(57) ABSTRACT

Apparatus and method for generating high quality synthesized speech having smooth waveform concatenation. The apparatus includes a pitch frequency calculation section, a pitch synchronization position calculation section, a unit waveform storage, a unit waveform selection section, a unit waveform generation section, and a waveform synthesis section. The unit waveform generation section includes a conversion ratio calculation section, a sampling rate conversion section, and a unit waveform re-selection section. The conversion ratio calculation section calculates a sampling rate conversion ratio from the pitch information and the position of pitch synchronization, and the sampling rate conversion section converts the sampling rate of the unit waveform, delivered as input, based on the sampling rate conversion ratio. The unit waveform re-selection section selects, from the sampling-rate-converted unit waveform, the unit waveform having a phase necessary to obtain a synthesized speech waveform which will exhibit smooth waveform concatenation.

12 Claims, 21 Drawing Sheets

U.S. PATENT DOCUMENTS

| | | | | | |
|---|---|---|---|---|---|
| 5,641,926 | A | * | 6/1997 | Gibson et al. | 84/603 |
| 5,701,391 | A | * | 12/1997 | Pan et al. | 704/212 |
| 5,839,390 | A | * | 11/1998 | Meads | 119/174 |
| 5,848,390 | A | * | 12/1998 | Matsumoto | 704/260 |
| 5,987,405 | A | * | 11/1999 | Bantz et al. | 704/220 |
| 6,029,134 | A | * | 2/2000 | Nishiguchi et al. | 704/268 |
| 6,332,121 | B1 | * | 12/2001 | Kagoshima et al. | 704/262 |
| 6,789,066 | B2 | * | 9/2004 | Junkins et al. | 704/500 |
| 6,816,833 | B1 | * | 11/2004 | Iwamoto et al. | 704/207 |
| 7,010,491 | B1 | * | 3/2006 | Kikumoto | 704/503 |
| 7,343,286 | B2 | * | 3/2008 | Huang | 704/229 |
| 2003/0182107 | A1 | * | 9/2003 | Chan | 704/212 |
| 2004/0220801 | A1 | * | 11/2004 | Sato | 704/207 |
| 2006/0069565 | A1 | * | 3/2006 | Hiraishi | 704/258 |

FOREIGN PATENT DOCUMENTS

| | | | | |
|---|---|---|---|---|
| JP | 07-219576 | | | 8/1995 |
| JP | 7-219579 | A | | 8/1995 |
| JP | 9-319390 | A | | 12/1997 |
| JP | 10-161690 | | | 6/1998 |
| JP | 2005018036 | A | * | 1/2005 |

OTHER PUBLICATIONS

International Search Report of PCT/JP2006/317432 dated Nov. 7, 2006.

International Preliminary Report on Patentability ; Application No. PCT/JP2006/317432.

JP Office Action dated Jan. 10, 2012, with English Translation.

* cited by examiner

FOR CONVERSION RATIO= 1

WAVEFORM COMPRESSION
SAVE IN STORAGE 1

FOR CONVERSION RATIO= 2

WAVEFORM COMPRESSION
SAVE IN STORAGE 2

FOR CONVERSION RATIO= 3

WAVEFORM COMPRESSION
SAVE IN STORAGE 3

FOR CONVERSION RATIO= 4

WAVEFORM COMPRESSION
SAVE IN STORAGE 4

0123

0
WAVEFORM COMPRESSION
SAVE IN STORAGE 1

2
WAVEFORM COMPRESSION
SAVE IN STORAGE 2

1
3
WAVEFORM COMPRESSION
SAVE IN STORAGE 4

METHOD, APPARATUS AND PROGRAM FOR SPEECH SYNTHESIS

TECHNICAL FIELD

This invention relates to a speech synthesis technique. More particularly, this invention relates to a method, an apparatus and a program for synthesizing the speech from a text.

BACKGROUND ART

A variety of speech synthesis apparatus have been developed which analyze a text sentence and generate synthesized speech by synthesis by rule from the speech information indicated by the sentence.

Among these, typical conventional apparatus for speech synthesis, employing the synthesis by rule, includes a storage in which are stored in large amount,

- unit waveforms (unit waveforms of durations of the order of a syllable or pitch extracted from natural speech, for instance);
- phonological information such as information on an environment in which a phoneme is uttered, or on pitch shape in the phoneme, amplitude or duration; and
- prosodic information.

At the time of speech synthesis, a conventional speech synthesis apparatus, employing the synthesis by rule, reads an optimum unit waveform from the storage, based on phonological information and prosodic information, generated from the results of analysis of an input text sentence. The apparatus then concatenates a plurality of unit waveforms, as it places the so read out unit waveforms at the positions of pitch synchronization (a waveform center location of each unit waveform) as generated from the prosodic information. The apparatus then outputs the synthesized speech.

In the conventional speech synthesis apparatus, the position of pitch synchronization is controlled at a precision of the sampling period of the synthesized speech.

This leads to lowered precision of the position of pitch synchronization and to deteriorated sound quality of the synthesized speech. If, in particular, the pitch frequency is high and the interval between the positions of pitch synchronization is narrow, an error in the position of pitch synchronization leads to significant deterioration in the sound quality.

To overcome the above problem inherent in the speech synthesis apparatus, attempts have been made to improve the precision in the position of pitch synchronization.

For example, Patent Document 1 discloses a method and an apparatus for speech synthesis in which the sampling rate of a unit waveform is converted at the time of speech synthesis to control the position of pitch synchronization with an accuracy higher than the width of change of the minimum pitch time duration as determined by the sampling frequency. A unit waveform processing section performs n-fold sampling frequency conversion on the unit waveform sliced from a file (i.e. the above storage) by a unit waveform generation section in accordance with phonological parameters. The unit waveform processing section then re-samples the data, resulting from the frequency conversion, with the original sampling frequency, as the sampling start position is changed, to generate n unit waveforms each having a different phase. A unit waveform placement section selects, out of these n unit waveforms, the waveform of the phase as determined by a unit waveform location controller, in accordance with the phonological parameter having the n-fold pitch period parameter, and places the so selected waveform at a temporal position as determined by the unit waveform location controller.

The processing of the conventional technique for speech synthesis, which reads unit waveforms from the storage holding the unit waveform information, based on prosody, phonology and pitch frequency, and which then carries out the conversion of the sampling rate of the so read out unit waveforms, will now be described with reference to the waveform diagrams of FIGS. 21A to 21E. It is assumed that, in the example of FIGS. 21A to 21E, the position of pitch synchronization is approximately 49.75, and that the conversion ratio is 4.

FIG. 21A shows the state before placing the unit waveform. It is assumed that, in the present example, a thick elongated line in FIG. 21A denotes the position of pitch synchronization.

It is then assumed that a unit waveform, shown in FIG. 21B, has been selected from the storage based on prosody, phonology and pitch frequency. If the sampling rate conversion is then carried out on this unit waveform, with the conversion ratio of 4, the waveform shown in FIG. 21E is generated.

As a method for converting the sampling rate, there is such as method in which a zero sample interpolation and a low pass filter (LPF) are combined.

With the conversion ratio equal to N, (N−1) sampling points, each with a value of zero, are inserted between neighboring sampling points, in order to make the number of data points N times that before conversion.

The resulting waveform is passed through a low-pass filter having, as the passband, the same band as that of the waveform prior to sampling rate conversion. The waveform resulting from this processing is the unit waveform of the converted sampling rate N times as high as that before conversion.

Out of the unit waveforms which have undergone sampling-rate-conversion, that is, rate-converted waveforms, unit waveforms are read at a pre-conversion sampling rate, as the read positions are shifted by one sample for each readout operation. This yields N unit waveforms, each with a phase (position of the waveform center of the unit waveform) differing by 1/N sample. In short, it may be said that N unit waveforms, each having a different phase, have now been generated by the sampling rate conversion.

Out of N type of unit waveforms (not shown), the waveform shown in FIG. 21D then is selected as the waveform having a phase such that the waveform center coincides with the position of pitch synchronization. The processing of extracting the waveform having a specified phase out of the unit waveforms which have undergone sampling-rate-conversion is the processing of lowering the sampling rate and hence is herein sometimes referred to as the 'processing for waveform decimation'.

When the so selected unit waveform is placed at the position of pitch synchronization, there is obtained a state in which the unit waveform has been placed in position, as shown in FIG. 21E.

[Patent Document 1]

JP Patent Kokai Publication No. JP-A-9-31939

DISCLOSURE OF THE INVENTION

Problems to be Solved by the Invention

However, the conventional speech synthesis technique, described in e.g. the aforementioned Patent Document 1, suffers the following disadvantages.

A tremendous amount of computational operations for sampling rate conversion is required.

If, in conventional speech synthesis apparatus, the sampling rate of a unit waveform is to be converted in the course of speech synthesis, the processing for conversion is carried out at the preset conversion ratio. Thus, if the position of pitch synchronization is to be controlled at all times to high accuracy, with a view to preventing deterioration of the sound quality of the synthesizes speech, a tremendous amount of processing computational operations is required for sampling rate conversion.

That is, a voluminous storage capacity is needed for the storage in which to store the information on the unit waveforms.

If, in a conventional speech synthesis apparatus, a storage constituted by sampling-rate-converted unit waveforms is used, the entire unit waveforms registered in the storage, are generated at a common sampling rate conversion ratio. Moreover, the processing for compression of an amount of unit waveform data, such as processing for waveform compression, is not carried out. For this reason, the storage of a tremendous storage capacity is needed to control the position of pitch synchronization to a high accuracy with a view to preventing deterioration of the sound quality of the synthesized speech.

Furthermore, if, in the conventional speech synthesis apparatus, a storage, holding unit waveforms on memory, is produced, with the use of, for example, the processing for sampling rate conversion, the unit waveforms, stored in the storage, are of lower quality than in case the storage is produced using unit waveforms sampled at a higher rate. In particular, with a high conversion ratio, the difference in quality of the unit waveforms, registered in the storage, becomes outstanding, thus producing the difference in the quality of unit waveforms registered in the storage.

It is therefore an object of the present invention to provide a method and an apparatus according to which the speech may be synthesized to a desired sound quality even in case the amount of computation for controlling the position of pitch synchronization is reduced.

It is another object of the present invention to provide a method and an apparatus according to which the speech may be synthesized to a desired sound quality even in case the position of pitch synchronization is to be controlled with the reduced capacity of the storage in which to store unit waveforms.

Means to Solve the Problems

To solve the above problem, the invention disclosed in the present application is arranged substantially as follows:

The speech synthesis apparatus according to a first aspect of the present invention calculates a sampling rate conversion ratio, optimum for achieving the desired sound quality even on the occasion of controlling the position of pitch synchronization with smaller computation amount, based on the pitch frequency and the position of pitch synchronization, and converts the sampling rate of a unit waveform in accordance with the so computed conversion ratio.

The apparatus according to the present invention is a speech synthesis apparatus for concatenating a plurality of unit waveforms to generate the synthesized speech, there being a plurality of sampling rates of the unit waveforms, with the sampling rates of the unit waveforms being constant number multiples of the sampling rate for the synthesized speech. The apparatus comprises a decimation section for decimating the unit waveforms having the sampling rate higher than the sampling rate of the synthesized speech, to the sampling rate of the synthesized speech, and a waveform synthesis section for generating the synthesized speech using the decimated unit waveforms.

The speech synthesis apparatus according to the present invention may further comprise a conversion section for performing conversion that increases the sampling rate of the unit waveform. The unit waveform thus converted may be supplied as input to the decimation section.

In the speech synthesis apparatus according to the present invention, the conversion section may change the conversion ratio based on the input prosodic information.

In the speech synthesis apparatus according to the present invention, the conversion section may find the pitch frequency from the prosodic information and increase the value of the conversion ratio to a higher value in case of a higher value of the pitch frequency.

In the speech synthesis apparatus according to the present invention, the conversion section may find the position of pitch synchronization from the pitch frequency and use a conversion ratio which relatively reduces an error in the position of pitch synchronization.

In the speech synthesis apparatus according to the present invention, the conversion section may change the conversion ratio responsive to setting from outside the speech synthesis apparatus.

The present invention may include a unit waveform selection section that selects, from a storage holding on memory unit waveforms, one of the unit waveforms, based on the prosodic information and the phonological information, a sampling rate conversion section for generating, from the selected unit waveform, a unit waveform, the sampling frequency of which has been converted to a sampling rate different from the sampling rate for the unit waveform (a sampling-rate-converted unit waveform), and control means for changing the ratio of the sampling rate of the sampling-rate-converted unit waveform to the sampling rate of the unit waveform in case of generating the synthesized speech from the sampling-rate-converted unit waveform and the phonological information.

In the apparatus of the present invention, if the above ratio is to be changed, the ratio is changed based on the prosodic information In the apparatus of the present invention, if the above ratio is to be changed, the ratio is changed based on the pitch frequency which is found from the prosodic information.

In the apparatus of the present invention, the conversion ratio is determined based on the pitch frequency, and an error of the position of pitch synchronization is evaluated with respect to the conversion ratio as determined based on the pitch frequency. The conversion ratio may then be determined so that the error will be sufficiently small.

In changing the above ratio, the position of pitch synchronization may be found from the pitch frequency, and the above ratio may then be changed based on the position of pitch synchronization.

A speech synthesis apparatus in a second aspect of the present invention selects, out of a plurality of storages, holding on memory a variety of compressed unit waveforms, each having a different phase, a storage optimum for achieving the high sound quality, based on the pitch frequency and the position of pitch synchronization, and generates the synthesized speech, using the compressed unit waveform of the so selected storage.

Specifically, the apparatus according to the second aspect of the present invention includes a plurality of compressed unit waveform storages, constituted by compressed unit waveforms, each having a different phase, a unit waveform storage selection section for referencing the pitch frequency and the position of pitch synchronization to select an optimum compressed unit waveform storage, a compressed unit waveform selection section that selects a compressed unit waveform of an optimum phase, from so selected compressed unit waveform storage, and a unit waveform decompression section for decompressing the compressed unit waveform to generate a unit waveform.

The apparatus according to a third aspect of the present invention generates a compressed unit waveform storage based on the high sampling rate unit waveform, which is a unit waveform sampled at a sampling rate higher than that of the synthesized speech.

Specifically, the apparatus according to a third aspect of the present invention includes a unit waveform read position control section for controlling the read position of the unit waveform, based on the sampling rate of a high sampling rate unit waveform, and a unit waveform selection section that selects the unit waveform necessary for constructing the storage from the high sampling rate unit waveform based on the information of the unit waveform read position control section.

A method according to the present invention is a speech synthesis method for concatenating a plurality of unit waveforms to generate synthesized speech, there being a plurality of sampling rates of the unit waveforms, with the sampling rates of the unit waveforms being constant number multiples of the sampling rate for the synthesized speech. The method comprises:

a step of decimating the unit waveforms, having the sampling rate higher than the sampling rate of the synthesized speech, to the sampling rate of the synthesized speech, and a step of generating the synthesized speech using the decimated unit waveforms.

The speech synthesis method according to the present invention may further comprise a step of performing conversion that increases the sampling rate of the unit waveform. The unit waveform, having the sampling rate thus converted, is entered as an input to the decimating step.

In the speech synthesis method according to the present invention, the step of performing the conversion changes the conversion ratio based on the input prosodic information.

In the speech synthesis method according to the present invention, the step of performing the conversion finds the pitch frequency from the prosodic information and increases the value of the conversion ratio to a higher value in case of a higher value of the pitch frequency.

In the speech synthesis method according to the present invention, the step of performing the conversion finds the position of pitch synchronization from the pitch frequency and uses the value of the conversion ratio which relatively reduces an error in the position of pitch synchronization.

In the speech synthesis method according to the present invention, the step of performing the conversion changes the conversion ratio responsive to setting from outside.

The method according to the present invention includes the steps of:

selecting a unit waveform, from the storage, holding on memory the unit waveform, based on the prosodic information and the phonological information, generating unit waveforms, the sampling rates of which have been converted to a sampling rate differing from the sampling rate of the unit waveform (termed the unit waveforms which have undergone sampling-rate-conversion), from the selected unit waveform, and sequentially changing, in generating the synthesized speech from the unit waveforms which have undergone sampling-rate-conversion and the prosodic information, the ratio of the sampling rate of the unit waveforms which have undergone sampling-rate-conversion to the sampling rate of the unit waveform.

In the method according to the present invention, in changing the above ratio, the ratio is changed based on the prosodic information.

In the method according to the present invention, in changing the above ratio, the pitch information is found from the prosodic information, and the ratio is then changed based on the pitch frequency.

In the method according to the present invention, the conversion ratio is found based on the pitch frequency. The error in the position of pitch synchronization is evaluated, with respect to the conversion ratio, as found based on the pitch frequency, and the conversion ratio is found so that the error will become sufficiently small.

In the method according to the present invention, in changing the above ratio, the position of pitch synchronization is found from the pitch frequency, and the above ratio is changed based on the position of pitch synchronization.

A speech synthesis method according to the present invention comprises:

a step of generating a plurality of compressed unit waveforms from a unit waveform storage that holds on memory a unit waveform, and storing the compressed unit waveforms in a plurality of compressed unit waveform storages, a step of selecting, based on the prosodic information, one of the compressed unit waveform storages, a step of selecting a compressed unit waveform, from the compressed unit waveform storage selected, based on the prosodic information and the phonological information, a step of decompressing the compressed unit waveform, based on the identification information of the unit waveform storage selected, to derive a unit waveform, and a step of generating the synthesized speech from the prosodic information and the decompressed unit waveform.

In the method according to the present invention, in selecting the compressed unit waveform storage, the pitch information is found from the prosodic information, and the compressed unit waveform storage is selected based on the pitch frequency.

In the method according to the present invention, in selecting the compressed unit waveform storage, the position of pitch synchronization is found from the pitch frequency, and the compressed unit waveform storage is selected based on the position of pitch synchronization.

In the method according to the present invention, in generating the compressed unit waveform storage, the sampling-rate-converted unit waveform, having the sampling rate different from that of the unit waveform, is generated from the unit waveform, a plurality of unit waveforms, each having a different phase, are compressed to generate a plurality of compressed unit waveforms, and the compressed unit waveform storage is generated based on the plural compressed unit waveforms.

In the method according to the present invention, a plurality of unit waveforms, each having a different phase, are compressed to generate a plurality of compressed unit waveforms. In this case, the method for compression is determined depending on the phase of each unit waveform, and the compressed unit waveforms are generated based on the method for compression.

A method according to the present invention includes the steps of:

generating a plurality of compressed unit waveform storages from a speech waveform, the sampling frequency of which is higher than the sampling frequency of the unit waveform, selecting one of the compressed unit waveform storages, based on the prosodic information, selecting the compressed unit waveform from the selected compressed unit waveform storage, based on the prosodic information and the phonological information, decompressing the compressed unit waveform, based on the selected number of the Compressed unit waveform storage, to find the unit waveform, and generating the synthesized speech from the prosodic information and the unit waveform.

In the method according to the present invention, in generating the compressed unit waveform storage, a plurality of unit waveforms, each having a differing phase, are found from the speech waveform, the sampling rate of which is higher than that of the unit waveform, and the unit waveforms, each having a different phase, are compressed to generate a plurality of compressed unit waveforms to decide on the compressed unit waveform storage based on the plural compressed unit waveforms.

In the method according to the present invention, if, in compressing plural unit waveforms, each having a different phase, a plurality of compressed unit waveforms are to be generated, the method for compression is determined, based on the ratio of the sampling rate of the sampling-rate-converted unit waveform to the sampling rate of the unit waveform. The compressed unit waveforms are generated based on the method for compression thus determined.

A computer program according to the present invention is a program that causes a computer, constituting a speech synthesis apparatus, to execute the processing of concatenating unit waveforms to generate a synthesized speech. There are a plurality of sampling rates of the unit waveforms, with the sampling rates of the unit waveforms being constant number multiples of the sampling rate for the synthesized speech. The program causes the computer to execute:

the processing of decimating the unit waveforms, having the sampling rate higher than the sampling rate of the synthesized speech, to the sampling rate of the synthesized speech, and the processing of generating the synthesized speech using the decimated unit waveforms.

The computer program according to the present invention causes the computer to further execute:

the processing of performing conversion that increases the sampling rate of the unit waveform. The unit waveform, having the sampling rate thus converted, is entered as an input to the decimating processing.

In the computer program according to the present invention, the processing of performing the conversion changes the conversion ratio based on the input prosodic information.

In the computer program according to the present invention, the processing of performing the conversion finds the position of pitch synchronization from the prosodic information and increases the value of the conversion ratio to a higher value in case of a higher value of the pitch frequency.

In the computer program according to the present invention, the processing of performing the conversion finds the position of pitch synchronization from the pitch frequency and uses the value of the conversion ratio which relatively reduces an error in the position of pitch synchronization.

In the computer program according to the present invention, the processing of performing the conversion changes the conversion ratio responsive to setting from outside.

A computer program according to the present invention is a program for causing a computer, constituting the speech synthesis apparatus, to execute:

the processing of selecting a unit waveform, based on the prosodic information and the phonological information, from a storage holding on memory the information on at least one unit waveform, the processing of generating, from the selected unit waveform, a sampling-rate-converted unit waveform having a sampling rate different from the sampling rate of the unit waveform selected; and the processing of changing, in generating the synthesized speech from the sampling-rate-converted unit waveform and the prosodic information, the conversion ratio which is the ratio of the sampling rate of the sampling-rate-converted unit waveform to the sampling rate of the unit waveform.

A computer program according to the present invention may be configured as a program for causing a computer, constituting a speech synthesis apparatus, to execute:

the processing of generating a plurality of compressed unit waveforms from a unit waveform storage holding on memory a unit waveform, and storing the compressed unit waveforms in a plurality of compressed unit waveform storages;

the processing of selecting, based on the prosodic information, one of the compressed unit waveform storages;

the processing of selecting a compressed unit waveform, from the compressed unit waveform storage selected, based on the prosodic information;

the processing of decompressing the compressed unit waveform, based on the identification information of the unit waveform storage selected, to derive a unit waveform; and the processing of generating the synthesized speech from the prosodic information and the decompressed unit waveform.

A computer program according to the present invention may be configured as a program for causing a computer, constituting a speech synthesis apparatus, to execute:

the processing of generating a plurality of compressed unit waveform storages from a speech waveform having a sampling rate higher than the sampling rate of a unit waveform, the processing of selecting one of a plurality of compressed unit waveform storages based on the prosodic information, the processing of selecting a compressed unit waveform from the selected compressed unit waveform storage based on the prosodic information and the phonological information, the processing of decompressing the compressed unit waveform, based on the identification information of the selected compressed unit waveform storage, to find the unit waveform and the processing of synthesizing the synthesized speech from the prosodic information and the unit waveform.

Meritorious Effects of the Invention

According to the present invention, the sampling rate conversion ratio, optimum for achieving the high sound quality, is computed based on the pitch frequency and on the position of pitch synchronization, even in case the position of pitch synchronization is controlled with the computation amount smaller than in case sampling rate conversion is carried out using the same conversion ratio. As a consequence, the high sound quality may be achieved with the smaller computation amount than in case computation is carried out based on the pitch frequency and on the position of pitch synchronization. The unit waveforms may thus be smoothly concatenated, with the smaller computation amount, thereby achieving the synthesized speech of a high sound quality.

According to the present invention, the storage optimum for controlling the position of pitch synchronization is selected, based on the pitch frequency and the position of pitch synchronization, out of the plural storages, constituted by compressed unit waveforms, each having a different phase. Thus, the high sound quality may be achieved even in case the position of pitch synchronization is controlled by the storage smaller in size than the storage constituted by the unit waveform the sampling frequency of which has been converted with the same conversion ratio. As a consequence, the unit waveforms may smoothly be concatenated with the use of the unit waveform storage of a smaller size, thereby generating the synthesized speech of a higher sound quality.

According to the present invention, the compressed unit waveform storage is generated based on the unit waveform, sampled with a sampling rate higher than the sampling rate of the synthesized speech. It is thus possible to generate a storage constituted by a unit waveform higher in waveform quality than the sampling-rate-converted unit waveform. As a consequence, the synthesized speech may be generated from the high quality unit waveforms to improve the sound quality of the synthesized speech.

EXPLANATIONS OF SYMBOLS

Figure 1:
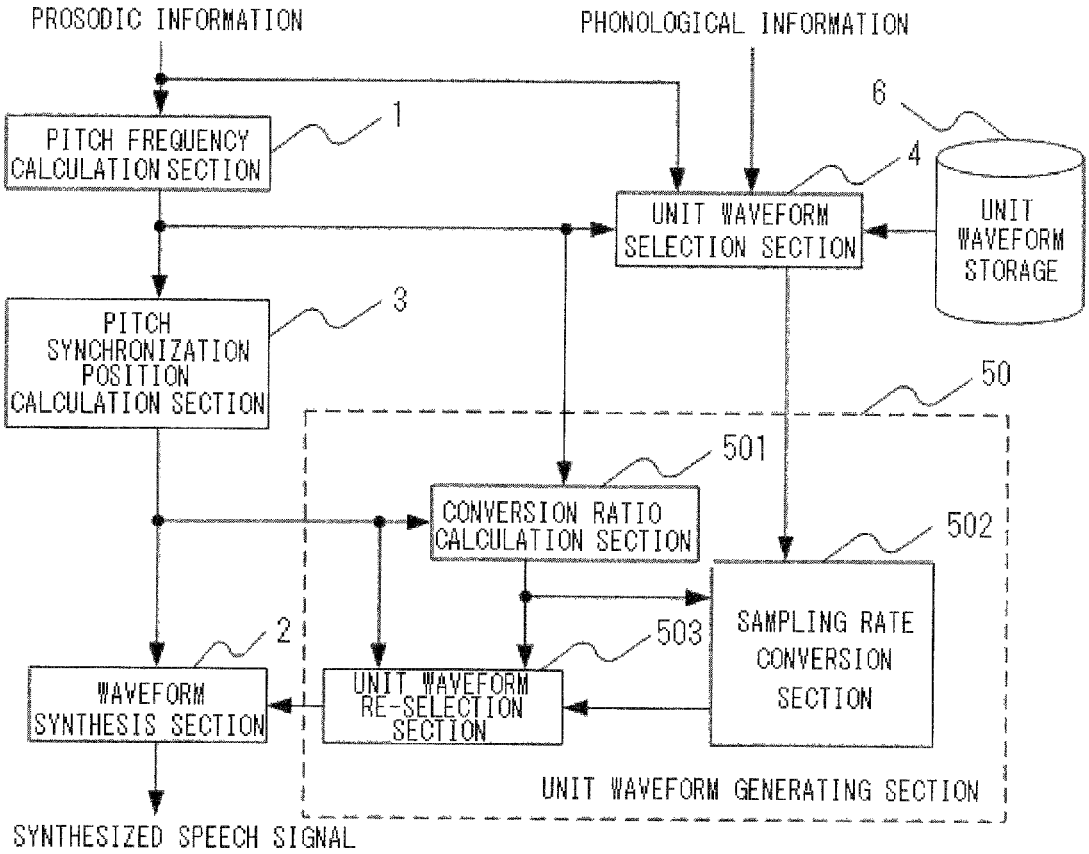
FIG. 1 is a block diagram showing the configuration of a first embodiment of the present invention.

1 pitch frequency calculation section
2 waveform synthesis section
3 pitch synchronization position calculation section
4, 22, 33 unit waveform selection sections
6 unit waveform storage
7, 71 unit waveform storage selection sections
8, 81 compressed unit waveform selection sections
10 vocal tract filter
11 vocal tract filter coefficient storage
12, 13 sound source signal generation sections
20 conversion ratio control section
21 sampling rate conversion section
23, 34 unit waveform compression sections
24, 35 compressed unit waveform storage select ion sections
25, 36 compression method selection sections
31 unit waveform read position control section
32 LPF
38 high sampling rate unit waveform storage
39 sampling rate storage
50, 55 unit waveform generation sections
51 unit waveform decompression section
$\mathbf{62}_1$, $\mathbf{62}_2$, . . . , $\mathbf{62}_k$, $\mathbf{63}_1$, $\mathbf{63}_2$, . . . , $\mathbf{63}_k$ compressed unit waveform storages
91, 92 compressed unit waveform storage generation sections
500 conversion ratio storage/setting section
501 conversion ratio calculation section
502 sampling rate conversion section
503 unit waveform re-selection section
555 waveform generation processing switching section

PREFERRED MODES FOR CARRYING OUT THE INVENTION

For further detailed explanation of the present invention, outlined as above, reference is made to the accompanying drawings. The apparatus according to the present invention is a speech synthesis apparatus for concatenating a plurality of unit waveforms to generate the synthesized speech. There are a plurality of sampling rates of the unit waveforms, with the sampling rates of the unit waveforms being constant number multiples of the sampling rate for the synthesized speech. The apparatus comprises means (such as 503 of FIG. 1) for decimating the unit waveforms, having the sampling rate higher than the sampling rate of the synthesized speech, to the sampling rate of the synthesized speech, and means (such as 2 of FIG. 1) for connecting the decimated unit waveforms to generate the synthesized speech. The apparatus according to the present invention may further include converting means (such as 502 of FIG. 1) for increasing the sampling rate of the unit waveform, with the rate-converted unit waveform being supplied as input to the decimation section. More specifically, with reference to FIG. 1, the apparatus according to the present invention includes a unit waveform storage (6) for storing the information for at least one unit waveform, and a unit waveform selection section (4) for selecting the unit waveform from the unit waveform storage based on the prosodic information and the phonological information. The apparatus also includes a sampling rate conversion section (502) for generating, from the selected unit waveform, a sampling-rate-converted unit waveform, having a sampling rate different from the sampling rate of the selected unit waveform, from the selected unit waveform. The apparatus also includes a conversion ratio calculation section (501) for changing the conversion ratio, which is the ratio of the sampling rate of the above sampling-rate-converted unit waveforms to that of the unit waveform, when the synthesized speech is generated from the sampling-rate-converted unit waveform and the prosodic information. The apparatus also includes a unit waveform re-selection section (503) (decimation section) for selecting a unit waveform from the above sampling-rate-converted unit waveforms based on the position of pitch synchronization. The apparatus further includes a waveform synthesis section (2) for placing and connecting the unit waveforms at the positions of pitch synchronization to synthesize a waveform, which is the synthesized speech signal, and for delivering the synthesized waveform as output. The conversion ratio calculation section (501) finds the pitch frequency from the prosodic information and finds the position of pitch synchronization from the pitch frequency to calculate the conversion ratio matched to the pitch frequency and to the position of pitch synchronization. Or, the conversion ratio may be changed by setting from outside the speech synthesis apparatus. In the present embodiment, the high quality sound may be generated with the amount of computation lesser than if conversion of the sampling rate is carried out with the same conversion ratio. As a consequence, the unit waveforms may be concatenated smoothly with the lesser amount of computation to generate the high-quality synthesized speech.

Figure 3:
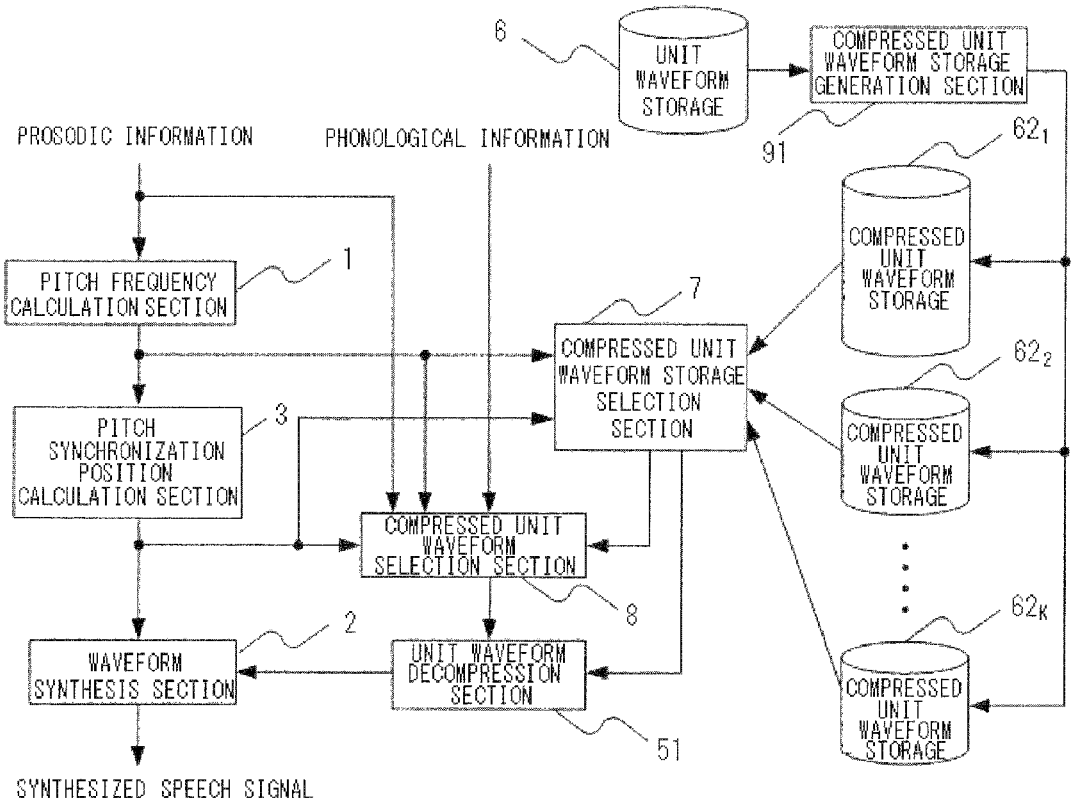
FIG. 3 is a block diagram showing the configuration of a second embodiment of the present invention.

Another embodiment of the present invention, shown in FIG. 3, includes a unit waveform storage selection section (7) for selecting a compressed unit waveform storage, out of plural compressed unit waveform storages, based on the input prosodic information and the phonological information, a compressed unit waveform selection section (8) for selecting the compressed unit waveform, based on the prosodic information and the phonological information, from the selected compressed unit waveform storage, a unit waveform decompression section (51) for decompressing the compressed unit waveform based on the identification information of the selected compressed unit wave form storage to find a unit waveform, and a waveform synthesis section (2) for generating the synthesized speech from the prosodic information and the decompressed unit waveform. With the present embodiment, such compressed unit waveform storage optimum for controlling the position of pitch synchronization to high accuracy is selected, based on the pitch frequency and on the position of pitch synchronization, out of the compressed unit waveform storages, constituted by a plural number of compressed unit waveforms, each having a different phase, whereby it is possible to smoothly concatenate unit waveforms in a small-size compressed unit waveform storage to generate the synthesized speech of high sound quality.

Figure 8:
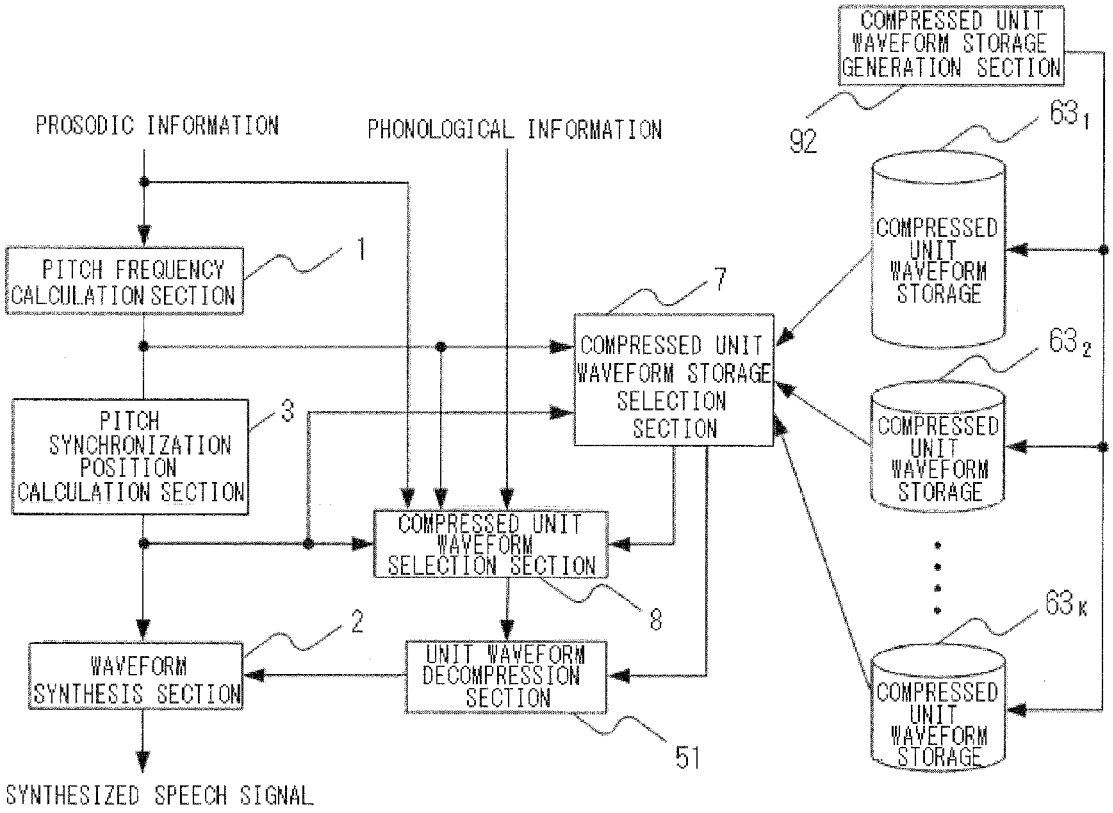
FIG. 8 is a block diagram showing the configuration of a third embodiment of the present invention.

A further embodiment of the present invention, shown in FIG. 8, includes a compressed unit waveform storage generation section (92) for generating, from a speech waveform, having a sampling rate higher than that of the unit waveform, a plurality of compressed unit waveforms to be stored in the plural compressed unit waveform storages, a unit waveform storage selection section (7) for selecting one of a plurality of compressed unit waveform storages, based on the prosodic information, a compressed unit waveform selection section (8) for selecting a compressed unit waveform, based on the prosodic information and the phonological information, out of the compressed unit wave forms stored in the selected compressed waveform storage, a unit waveform decompression section (51) for decompressing the compressed unit waveform to find a unit waveform, based on the identification information in the selected compressed unit waveform storage, and a waveform synthesis section (2) for generating the synthesized speech from the prosodic information and the decompressed unit waveform. With the present embodiment, according to which a compressed unit waveform storage is generated based on the unit waveform sampled at a sampling rate higher than that of the synthesized speech, a unit waveform storage may be generated which is constituted by the unit waveform having a waveform quality higher than that of the unit waveform obtained on sampling rate conversion. The present invention will now be described in detail with reference to concrete embodiments.

First Example

Figure 2:
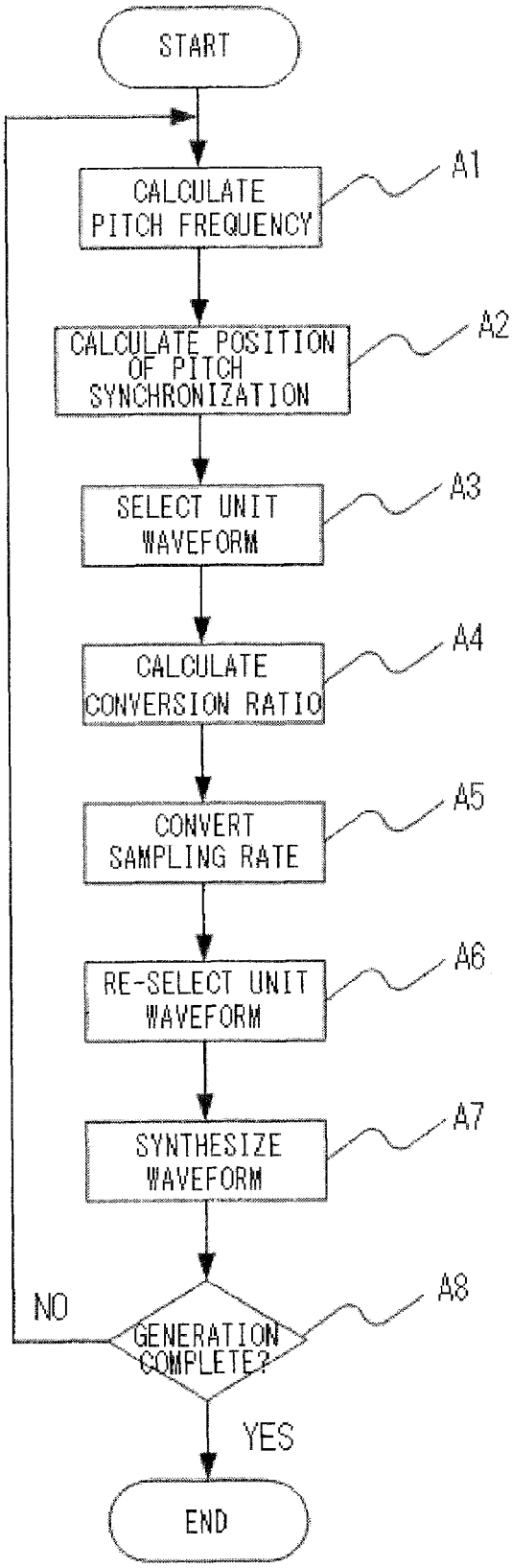
FIG. 2 is a flowchart for illustrating the operation of the first embodiment of the present invention.

FIG. 1 shows the configuration of the first example of the present invention. FIG. 2 depicts a flowchart for illustrating the operation of the first example of the present invention.

Referring to FIG. 1, the speech synthesis apparatus according to the first example of the present invention includes a pitch frequency calculation section 1, a pitch synchronization position calculation section 3, a unit waveform selection section 4, a unit waveform storage 6, a conversion ratio calculation section 501, a sampling rate conversion section 502, a unit waveform re-selection section 503 and a waveform synthesis section 2.

The pitch frequency calculation section 1 calculates the pitch frequency from the prosodic information and delivers it to the pitch synchronization position calculation section 3 and to the unit waveform selection section 4 (step A1 of FIG. 2).

The pitch synchronization position calculation section 3 calculates the position of pitch synchronization, based on the pitch frequency, supplied from the pitch frequency calculation section 1, and delivers it to the waveform synthesis section 2, conversion ratio calculation section 501 and to the unit waveform re-selection section 503 (step A2).

The pitch frequency and the position of pitch synchronization, calculated by the pitch frequency calculation section 1 and by the pitch synchronization position calculation section 3, respectively, are represented by floating point format.

The unit waveform storage 6 holds a variety of unit waveforms and the attribute information thereof as required for generating the synthesized speech.

The unit waveform selection section 4 reads the unit waveforms, from the unit waveform storage 6, based on the prosodic information, phonological information and the pitch frequency supplied from the pitch frequency calculation section 1, and delivers them to the sampling rate conversion section 502 (step A3).

The conversion ratio calculation section 501 decides on the conversion ratio for the sampling rate, based on the pitch frequency supplied from the pitch frequency calculation section 1 and the position of pitch synchronization supplied from the pitch synchronization position calculation section 3. The conversion ratio calculation section delivers the so determined conversion ratio to the sampling rate conversion section 502 and to the unit waveform re-selection section 503 (step A4 of FIG. 2).

Based on the conversion ratio, supplied from the conversion ratio calculation section 501, the sampling rate conversion section 502 generates a sampling-rate-converted unit waveform, having the sampling rate different from that of the unit waveform, based on the unit waveform supplied from the unit waveform selection unit 4. The sampling rate conversion section delivers the sampling-rate-converted unit waveform to the unit waveform re-selection section 503 (step A5).

Basically, the number of data points (number of sampling points) of the unit waveform is changed. For example, if the conversion ratio is N, the number of data points of the sampling-rate-converted unit waveform is N times that before conversion. Since the time duration of the unit waveform is unchanged, the sampling rate after the conversion is N times that before conversion.

With the present embodiment, the method for sampling rate conversion may be exemplified by a method consisting in zero sample interpolation and a low-pass filter (LPF). To provide for N-tupled data points, (N−1) sampling points, having values equal to 0, are initially inserted between neighboring sampling points. The resulting waveform is passed through a low-pass filter having a passband that is the same band as that of the waveform before sampling rate conversion. The waveform resulting from this processing is a unit waveform the sampling rate of which is N times that before processing.

From the unit waveforms which have undergone sampling-rate-conversion, unit waveforms are read out, at a pre-conversion sampling rate, as the read position is shifted one sample each time. This yields N unit waveforms, each having a phase (waveform center position of the unit waveform) differing by 1/N sample. It may thus be said that the sampling rate conversion is generating N unit waveforms each having a different phase. Since the sampling rate before sampling rate conversion, that is, the sampling rate of the unit waveform, stored in the unit waveform storage 6, is the same as the sampling rate of the synthesized speech, the sampling rate before sampling rate conversion is termed the sampling rate for the synthesized speech for distinction from the sampling rate after sampling rate conversion.

The unit waveform re-selection section 503 selects the unit waveform, having a proper phase, out of the unit waveforms which have undergone sampling-rate-conversion, supplied from the sampling rate conversion section 502, based on the position of pitch synchronization, supplied from the pitch synchronization posit ion calculation section 3, and delivers the so selected unit waveform to the waveform synthesis section 2 (step A6).

The unit waveform re-selection section 503 selects the unit waveform, out of the unit waveforms which have undergone sampling-rate-conversion, so that the waveform center position of the so selected unit waveform will be at the time point closest to the position of pitch synchronization supplied from the pitch synchronization position calculation section 3.

The unit waveform may be selected by a technique of selecting a waveform having the phase closest to a value equal to a value p of a fractional part of the position of pitch synchronization minus unity (1−p), for instance.

Finally, the waveform synthesis section 2 places a plurality of the unit wave forms, supplied from the unit waveform re-selection section 503, at the positions of pitch synchronization, supplied from the pitch synchronization position calculation section 3, and concatenates the unit waveforms to synthesize the waveform (step A7) to output a synthesized speech signal.

When the generation of the synthesized speech has come to a close, the processing comes to an end. If otherwise, processing returns to a step A1 of FIG. 2 (step A8).

The operation and the effect of the present example will now be described mainly with regards to the conversion ratio calculation section 501.

If the sampling rate for the unit waveform is sufficiently high, it is possible to locate the unit waveform at a position sufficiently proximate to the position of pitch synchronization of the floating point format as output by the pitch synchronization position calculation section 3. However, in this case, voluminous computational operations are needed for sampling rate conversion.

If conversely the sampling rate conversion becomes lower, the amount of the computational operations for sampling rate conversion becomes smaller. However, an error between the position of pitch synchronization output from the pitch synchronization position calculation section 3 and the position of pitch synchronization after placing the unit waveform becomes larger to deteriorate the sound quality of the synthesized speech.

In the present example, the conversion ratio necessary to prevent the sound quality from being lowered may be found by analyzing the value of the fractional part of the position of pitch synchronization and the pitch frequency. It is therefore possible to reduce the amount of the computational operations as compared to the case where the sampling rate conversion is performed at a high conversion ratio at all times in order to prevent the sound quality from being lowered.

Initially, the conversion ratio calculation section 501 finds the conversion ratio based on the pitch frequency.

The conversion ratio calculation section 501 then evaluates an error of the position of pitch synchronization for the conversion ratio as found, based on the pitch frequency, in order to find the conversion ratio which will give a sufficiently small error.

In the present example, when the conversion ratio calculation section 501 determines the conversion ratio of the sampling rate, based on the pitch frequency, the conversion ratio for the sampling rate is basically increased in case the pitch frequency is of a higher value.

The reason is that, in case the pitch frequency is high, the interval between the position of pitch synchronization (pitch period) is small, and hence the effect an error in the position of pitch synchronization has on the pitch frequency becomes significant, thus possibly lowering the sound quality.

That is, the shift in the pitch frequency in case the pitch period has shifted by one sample becomes larger the higher the pitch frequency. For example, take a case in which, with the sampling rate (frequency) of 8000 Hz, the pitch period has shifted by one sample (0.125 [ms]). The following effect would then be produced:

If, with the pitch frequency of 50 Hz (with the pitch period of 20 ms), the pitch period is shifted by one sample, the pitch frequency is 50.31 Hz (19.88 ms). The rate of change of the pitch frequency then is 0.63%.

If, with the pitch frequency of 400 Hz (with the pitch period of 2.5 ms), the pitch period is shifted by one sample, the pitch frequency is 421.05 Hz (2.38 ms). The rate of change of the pitch frequency then is 5.26%.

The conversion ratio calculation section 501 then evaluates the errors in the positions of pitch synchronization, for various values of the conversion ratio, to find the value of the conversion ratio which will give a sufficiently small error value. The error herein means the difference between the position of pitch synchronization as found by the pitch synchronization position calculation section 3 (target position of pitch synchronization) as found by the pitch synchronization position calculation section 3 and the waveform center position of the waveform as selected out of the sampling-rate-converted unit waveforms (actual position of pitch synchronization).

In general, the larger the conversion ratio, the more variegated is the phase of the waveform generated, so that the error is decreased. That is, it becomes easier to obtain a unit waveform having a phase for which the error may be decreased. However, an error can be reduced, even with the small conversion ratio, depending on the value of the position of pitch synchronization.

Thus, in evaluating the error, in the present example, the rate of conversion is increased little by little, beginning from a small conversion ratio.

By setting an upper limit value of the conversion ratio, it becomes possible to prevent excessive increase in the amount of computation.

The conversion ratio obtained from the pitch frequency is compared to that obtained from the phase, and a smaller value of the two is selected as the conversion ratio. The so selected conversion ratio is transferred to the sampling rate conversion section 502 and to the unit waveform re-selection section 503.

To decrease the amount of computation needed to obtain the conversion ratio from the phase, it is also possible to carry out error evaluation based on the conversion ratio as found from the pitch frequency.

In case the error evaluated with the conversion ratio as found from the pitch frequency does not become sufficiently small, the conversion ratio as found from the pitch frequency is used, without doing error evaluation with a further higher conversion ratio.

In the present example, the conversion ratio is determined based on the pitch frequency and the position of pitch synchronization. As a modification, the conversion ratio may effectively be controlled from outside the speech synthesis apparatus, in case it is necessary to perform control of the processing load of the entire system having the built-in speech synthesis apparatus. In case the conversion ratio is made smaller, the amount of computation of the speech synthesis apparatus is decreased. If desired to decrease the computational load of the entire system, the conversion ratio may be made smaller to contribute to decreasing the computational load of the speech synthesis apparatus.

On the other hand, if there is allowance in the computation load of the entire system, such that computation amount of the speech synthesis apparatus may safely be increased, the conversion ratio may be increased to improve the sound quality of the synthesized speech. It is not mandatory to convert the sampling rate after setting the conversion ratio. In case there are limitations on the number of candidates of the conversion ratio, such a method may be used in which the sampling rate is converted for all of the candidates, the conversion ratio then is set and the sampling-rate-converted waveform then is selected which is matched to the so set conversion ratio.

In the present example, it is necessary to carry out, in generating the synthesized speech, the sampling rate conversion for all unit waveforms, as selected by the unit waveform selection section 4.

If the sampling-rate-converted waveforms are provided from the outset, it becomes unnecessary to effect sampling rate conversion at the time of the speech synthesis, thereby reducing the amount of computation to be carried out by the speech synthesis apparatus. However, in view of the limited storage capacity of the speech synthesis apparatus, it is difficult to hold all of the unit waveforms, generated for all values of the conversion ratio, in a non-compressed state.

If, with a view to holding many unit waveforms, all unit waveforms are compressed with a high compression ratio, it may sometimes occur that the amount of the computational operations, necessary for decompression of the compressed unit waveforms, becomes larger than with the sampling rate conversion system. This results because the higher the compression ratio, the larger becomes the processing amount necessary to effect decompression.

To suppress the capacity of the unit waveform storage from increasing, and to reduce the amount of computation necessary for decompressing the compressed unit waveforms, that is, to efficiently reduce the capacity of the unit waveform storage, it is necessary to set the compression ratio depending on how often the unit waveforms in question are used.

In the above-described first embodiment, the sampling rate conversion is used, with the unit waveforms needed at the time of synthesis varying in dependency upon the conversion ratio used. Thus, if the compression ratio, matched to the conversion ratio, is used, the unit waveform storage may efficiently be reduced in size. For example, the unit waveform, matched to the small conversion ratio, is used often, so that its compression ratio may be reduced.

Figure 4:
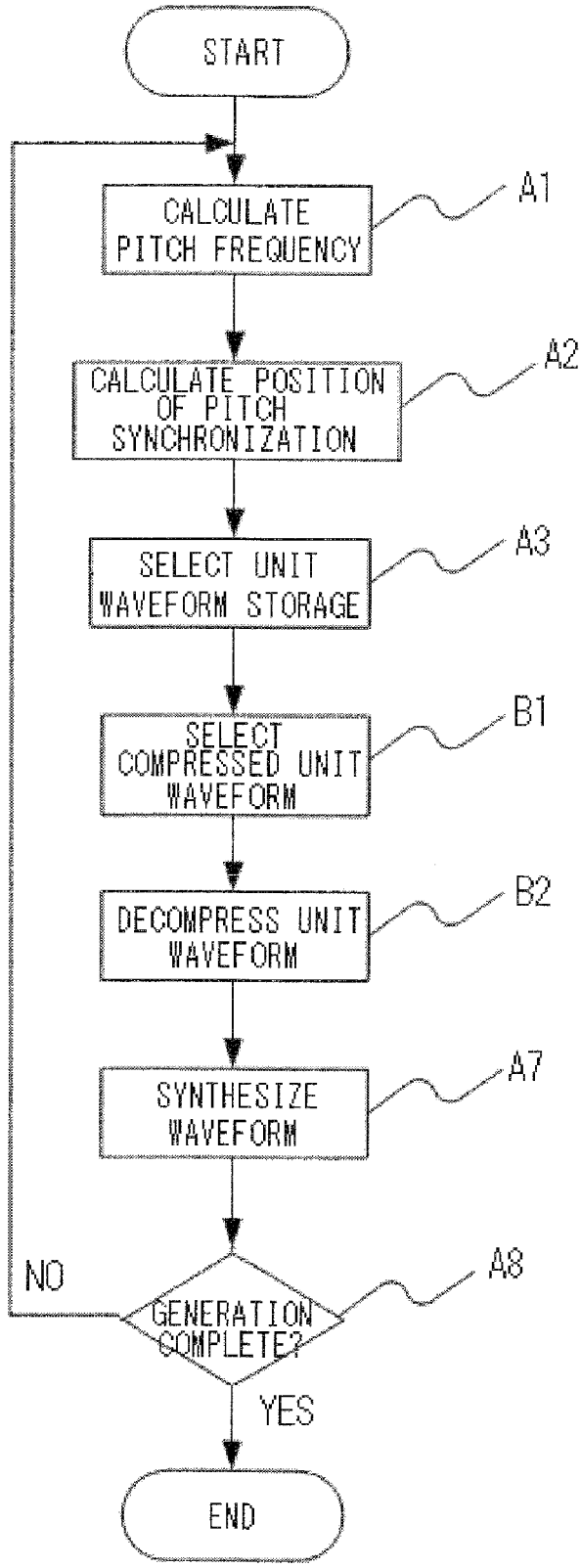
FIG. 4 is a flowchart for illustrating the operation of the second embodiment of the present invention.

A second example in which the unit waveforms, compressed at a compression ratio matched to the conversion ratio, are stored in a unit waveform storage, will now be described with reference to FIGS. 3 and 4.

It should be noticed that the pitch frequency calculation section 1, pitch synchronization position calculation section 3, unit waveform selection section 4, conversion ratio calculation section 501, sampling rate conversion section 502, unit waveform re-selection section 503 and the waveform synthesis section 2 of FIG. 1 may be implemented as a program run on a computer operating e.g., as a speech synthesis apparatus (speech signal generating apparatus).

Second Embodiment

FIG. 3 is a block diagram showing the configuration of the second example of the present invention. Referring to FIG. 3, the second example of the present invention includes, as compared to the first example of FIG. 1, a compressed unit waveform storage generation section 91, compressed unit waveform storages $\mathbf{62}_1$, $\mathbf{62}_2$, . . . , $\mathbf{62}_k$, and a unit waveform storage selection section 7.

Referring to FIG. 3, showing the present example, the unit waveform storage selection section 7 is provided in place of the unit waveform selection section 4 of FIG. 1, whilst a compressed unit waveform selection section 8 and a unit waveform decompression section 51 are provided in place of the conversion ratio calculation section 501, sampling rate conversion section 502 and the unit waveform re-selection section 503 of FIG. 1. The detailed operation is now described, mainly on these points of differences.

The unit waveform storage selection section 7 selects one of the compressed unit waveform storages $\mathbf{62}_1$, $\mathbf{62}_2$, . . . , $\mathbf{62}_k$, based on the pitch frequency supplied from the pitch frequency calculation section 1, and on the position of pitch synchronization, supplied from the pitch synchronization position calculation section 3. The unit waveform storage selection section delivers the compressed unit waveform information, registered in the selected unit waveform storage, to the compressed unit waveform selection section 8, while delivering the number of the selected compressed unit waveform storage to the unit waveform decompression section 51 (step A3 of FIG. 4).

The compressed unit waveform storages $\mathbf{62}_1, \mathbf{62}_2, \ldots, \mathbf{62}_k$ are associated with respective values of the sampling rate conversion ratio. Thus, the unit waveform storage selection section 7 calculates the conversion ratio from the position of pitch synchronization and the pitch frequency, and selects the compressed unit waveform storage associated with the conversion ratio thus calculated.

As the method for computing the conversion ratio, the method used in the conversion ratio calculation section 501 of FIG. 1 may be used.

The relationship of correspondence between the numbers of the compressed unit waveform storages and the values of the conversion ratio is determined by the compressed unit waveform storage generation section 91.

The compressed unit waveform selection section 8 selects the compressed unit waveform, registered in the compressed unit waveform storage, as selected by the unit waveform storage selection section 7, based on the prosodic information, the phonological information, the pitch frequency supplied from the pitch frequency calculation section 1, and on the position of pitch synchronization, supplied from the pitch synchronization position calculation section 3. The compressed unit waveform selection section supplies the so selected compressed unit waveform to the unit waveform decompression section 51 (step B1 of FIG. 4).

There are cases where the compressed unit waveform storages each hold a plurality of unit waveforms each having a different phase. So, the unit waveform having an optimum phase is selected, using the method employed in the unit waveform re-selection section 503.

The unit waveform decompression section 51 converts the compressed unit waveform, supplied from the compressed unit waveform selection section 8, into a unit waveform, and delivers it to the waveform synthesis section 2 (step B2).

Since the compression ratio and the method for compression for the compressed unit waveforms differ from one storage to another, the method for converting the compressed unit waveform into a unit waveform is determined based on the numbers of the compressed unit waveform storages supplied from the unit waveform storage selection section 7.

The compressed unit waveform storage generation section 91 processes and compresses the unit waveform, supplied from the unit waveform storage 6, and delivers the compressed unit waveform to the sole storage selected out of the compressed unit waveform storages $\mathbf{62}_1, \mathbf{62}_2, \ldots, \mathbf{62}_k$.

Since the huge amount of computation is needed for generating the compressed unit waveform storages, the compressed unit waveform storage generation section 91 generates the compressed unit waveform storages, before proceeding to processing of speech synthesis. That is, the compressed unit waveform storage generation section 91 is not in operation when speech synthesis processing is carried out.

In the present example, the compressed unit waveform storage generation section 91, unit waveform storage selection section 7, compressed unit waveform selection section 8 and the unit waveform decompression section 51 may be implemented by a program run on a computer.

The configuration and the operation of the compressed unit waveform storage generation section 91 will now be explained in detail with reference to FIGS. 5 and 6.

Figure 5:
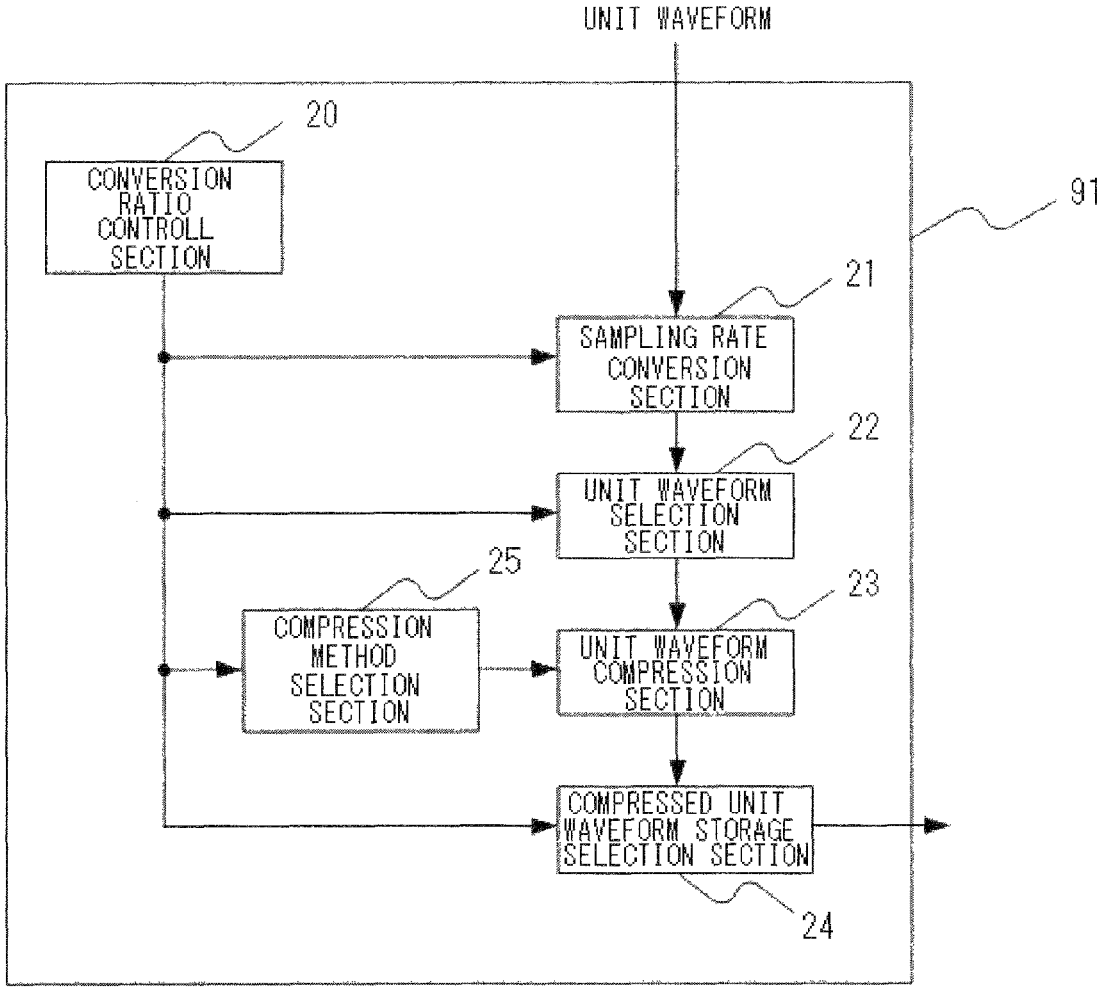
FIG. 5 is a block diagram showing the configuration of a compressed unit waveform storage generation section in the second embodiment of the present invention.

FIG. 5 depicts a block diagram showing the configuration of the compressed unit waveform storage generation section 91 of FIG. 3. Referring to FIG. 5, the compressed unit waveform storage generation section 91 includes a conversion ratio control section 20, a sampling rate conversion section 21, a unit waveform selection section 22, a unit waveform compression section 23 and a compressed unit waveform storage selection section 24. FIG. 6 depicts a flowchart for illustrating the operation of the compressed unit waveform storage generation section 91 of FIG. 5.

Figure 6:
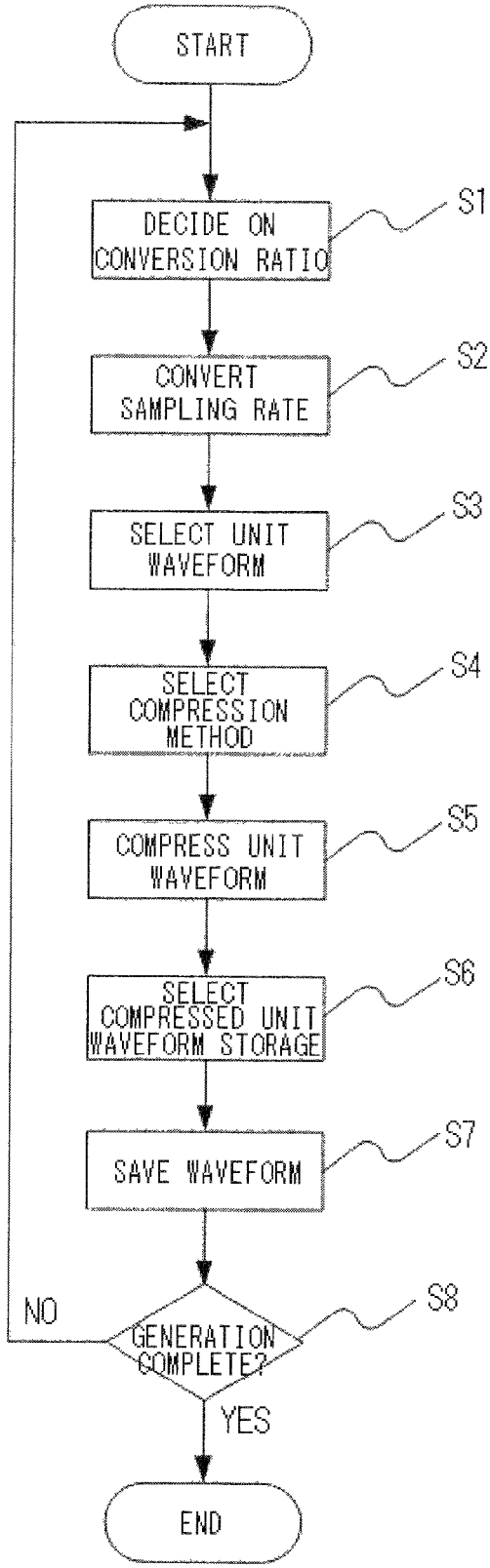
FIG. 6 is a flowchart for illustrating the processing flow in the compressed unit waveform storage generation section in the second embodiment of the present invention

The conversion ratio control section 20 selects a suitable one of the multiple values of the conversion ratio, and supplies the common value of the conversion ratio to the sampling rate conversion section 21, unit waveform selection section 22, unit waveform compression section 23 and to the compressed unit waveform storage selection section (step S1 of FIG. 6).

That is, the method for sampling rate conversion, the method for selecting the unit waveform, the method for compressing the unit waveform and the method for selecting the compressed unit waveform storage are determined by the conversion ratio.

The conversion ratio control section 20 outputs multiple values of the conversion ratio to the sole unit waveform supplied to the compressed unit waveform storage generation section 91.

The purpose of doing this is to generate multiple unit waveforms each having a different phase. The conversion ratio is increased little by little from a lower value up to an upper limit value as set depending on the maximum allowable capacity of the compressed unit waveform storage.

If, with a view to dispensing with the processing by the unit waveform storage selection section 7 of FIG. 3, only one compressed unit waveform storage is provided, the conversion ratio control section 20 outputs a sole value of the conversion ratio.

The sampling rate conversion section 21 converts the sampling rate of the unit waveform, supplied from the unit waveform storage 6 of FIG. 3, with the conversion ratio supplied from the conversion ratio control section 20, and supplies the so converted sampling rate to the unit waveform selection section 22 (step S2).

As the method for converting the sampling rate, the method used by the sampling rate conversion section 502 of FIG. 1 may be used.

The unit waveform selection section 22 selects, as it refers to the conversion ratio, supplied from the conversion ratio control section 20, the unit waveform having a phase unregistered in the storage, out of the unit waveforms which have undergone sampling-rate-conversion, supplied from the sampling rate conversion section 21, and supplies the so selected unit waveform to the unit waveform compression section 23 (step S3).

With the conversion ratio of N, for example, the unit waveform selection section 22 re-samples the sampling-rate-converted unit waveform, at each of the N sampling points, as the waveform read position is shifted by one sample each time, thereby generating N unit waveforms each having a different phase.

If there is a waveform, among the N unit waveforms, which has been generated with the conversion ratio equal to or less than N−1, such waveform has already been registered in the storage and hence is not transferred to the unit waveform compression section 23.

That is, only the waveforms not generated with the conversion ratio equal to or lesser than N−1 are transferred to the unit waveform compression section 23.

A compression method selection section 25 refers to the conversion ratio, supplied from the conversion ratio control section 20, to decide on the method for compression, to deliver the information on the method for compression to the unit waveform compression section 23 (step S4).

The information on the method for compression includes all information necessary for processing for waveform compression, including the compression system or compression ratio.

The unit waveform compression section 23 compresses the unit waveform, supplied from the unit waveform selection unit 22, based on the information on the compression method, supplied from the compression method selection section 25, to deliver the so compressed unit waveform to the compressed unit waveform storage selection section 24 (step S5).

Basically, the smaller the conversion ratio, the more often the unit waveform storage is used, so that its compression ratio is lowered.

For example, there is such a method in which, if three types of compressed unit waveform storages are generated with three types of the conversion ratios,

- the unit waveform with the smallest value of the conversion ratio is not compressed,
- the unit waveform with the second smallest value of the conversion ratio is compressed by differential coding (DPCM), and
- the unit waveform with the largest value of the conversion ratio is compressed by linear predictive coding (LPC).

If DPCM and LPC are compared to each other, the LPC is lower in the compression ratio, while the DPCM is smaller in the amount of computation necessary for decompression. In addition, the entropy coding, including, above all, the Huffmann coding, may be used.

The compressed unit waveform storage selection section 24 selects, as it refers to the conversion ratio, supplied from the conversion ratio control section 20, one of the compressed unit waveform storages $\mathbf{62}_1$, $\mathbf{62}_2$, . . . , $\mathbf{62}_k$ of FIG. 3, to deliver the compressed unit waveform, supplied from the unit waveform compression section 23, to the compressed unit waveform storage (steps S6 and S7).

When all of the compressed unit waveform storages $\mathbf{62}_1$, $\mathbf{62}_2$, . . . , $\mathbf{62}_k$ have been generated, processing comes to a close. If there is any compressed unit waveform storage, not generated, processing returns to the step S1 (step S8).

Referring to FIG. 7, the flow of generating multiple compressed unit waveform storages ($\mathbf{62}_1$, $\mathbf{62}_2$, . . . , $\mathbf{62}_k$ of FIG. 3) from a single unit waveform is now described (steps S1 to S8 of FIG. 6).

Figures 7A, 7B, 7C, 7D, 7E, 7F, 7G, 7H:
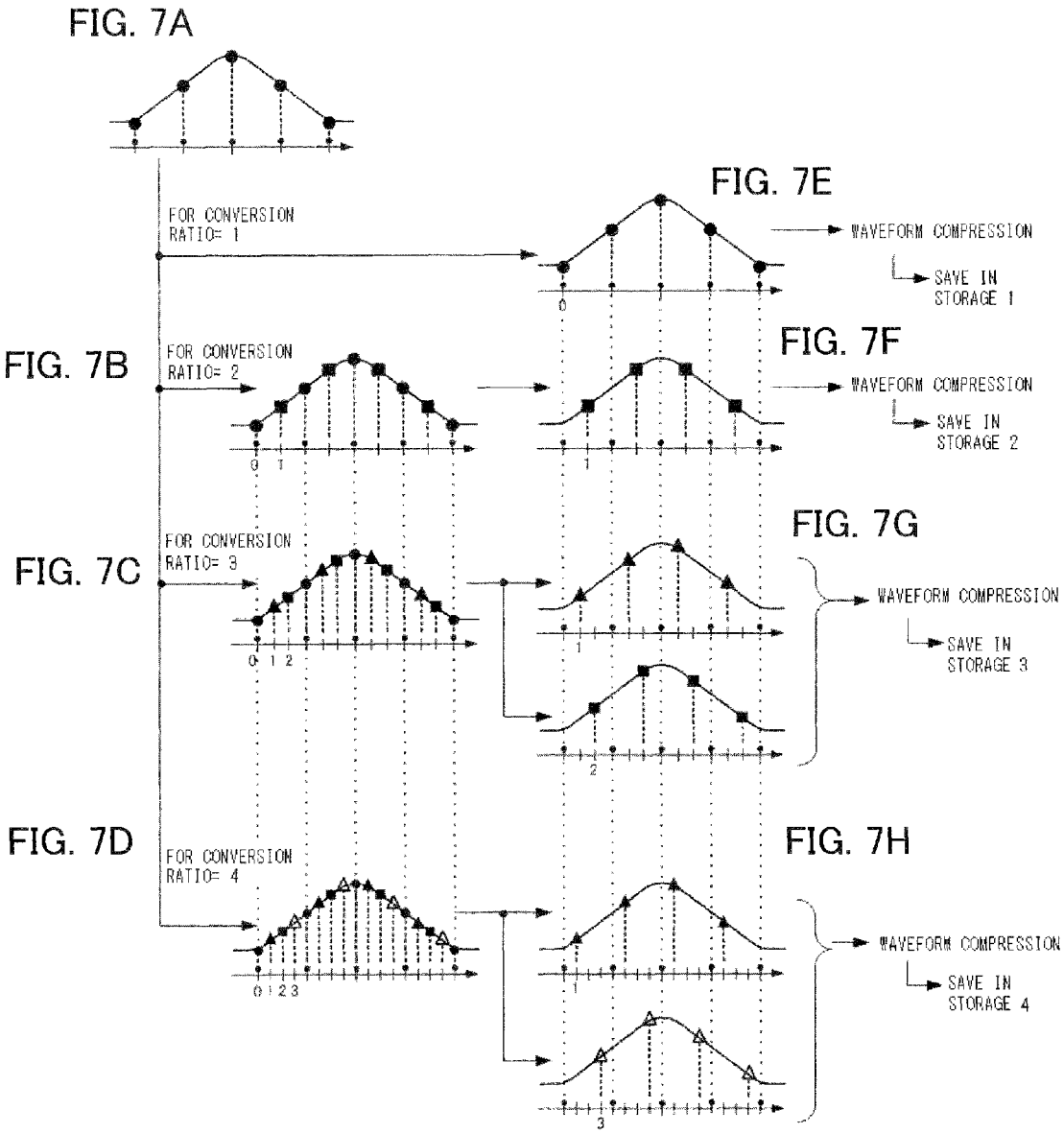
FIGS. 7A, 7B, 7C, 7D, 7E, 7F, 7G and 7H are graphs for illustrating the processing by the compressed unit waveform storage generation section in the second embodiment of the present invention.

FIG. 7A depicts a unit waveform before sampling rate conversion. For example, if the conversion ratio is set to 1 in a step S1 of FIG. 6, the waveform of FIG. 7E is obtained (steps S2 of FIG. 6).

This waveform is compressed (steps S3 to S5) and registered in a storage 1 (such as compressed unit waveform storage $\mathbf{62}_1$ of FIG. 3) (steps S6 and S7).

When the conversion ratio is 2, the waveform of FIG. 7B is obtained.

When the waveform is read from the read positions 0 and 1, the waveforms of FIGS. 7E and 7F are respectively obtained.

Since the waveform of FIG. 7E has been stored in the storage 1, only the waveform of FIG. 7F is compressed and registered in a storage 2 (such as compressed unit waveform storage $\mathbf{62}_2$ of FIG. 3).

If the conversion ratio is 3, the waveform of FIG. 7C is obtained. When the wave forms are read from the read positions 0, 1 and 2, the waveforms of FIGS. 7E and 7G are respectively obtained. Since the waveform of FIG. 7E has been stored in the storage 1, only two waveforms of FIG. 7G are compressed and registered in a storage 3 (such as compressed unit waveform storage $\mathbf{62}_3$).

If the conversion ratio is 4, the waveform of FIG. 7D is obtained. When the waveform is read out from the read positions 0, 1 and 2, the waveforms of FIGS. 7E, 7F and 7H are respectively obtained. Since the waveform of FIG. 7E has been stored in the storage 1, and the waveform of FIG. 7F has been stored in the storage 2, only two waveforms of FIG. 7H are compressed and registered in a storage 4 (such as compressed unit waveform storage $\mathbf{62}_4$).

In the present example, a unit waveform, having a sampling rate higher than that of the synthesized speech, is formulated by sampling rate conversion, and a plurality of unit waveforms, each having a different phase, are extracted therefrom to construct compressed unit waveform storages.

If unit waveforms, sampled at the outset at a high sampling rate, are used, a plurality of unit waveforms, each having a different phase, may be acquired without performing the processing of converting the sampling rate.

Since the processing of converting the sampling rate is not performed in this case, the unit waveform may be improved in waveform quality.

An example in which compressed unit waveform storages are formulated using unit waveforms sampled at the high sampling rate at the outset is now described.

Third Embodiment

Figure 9:
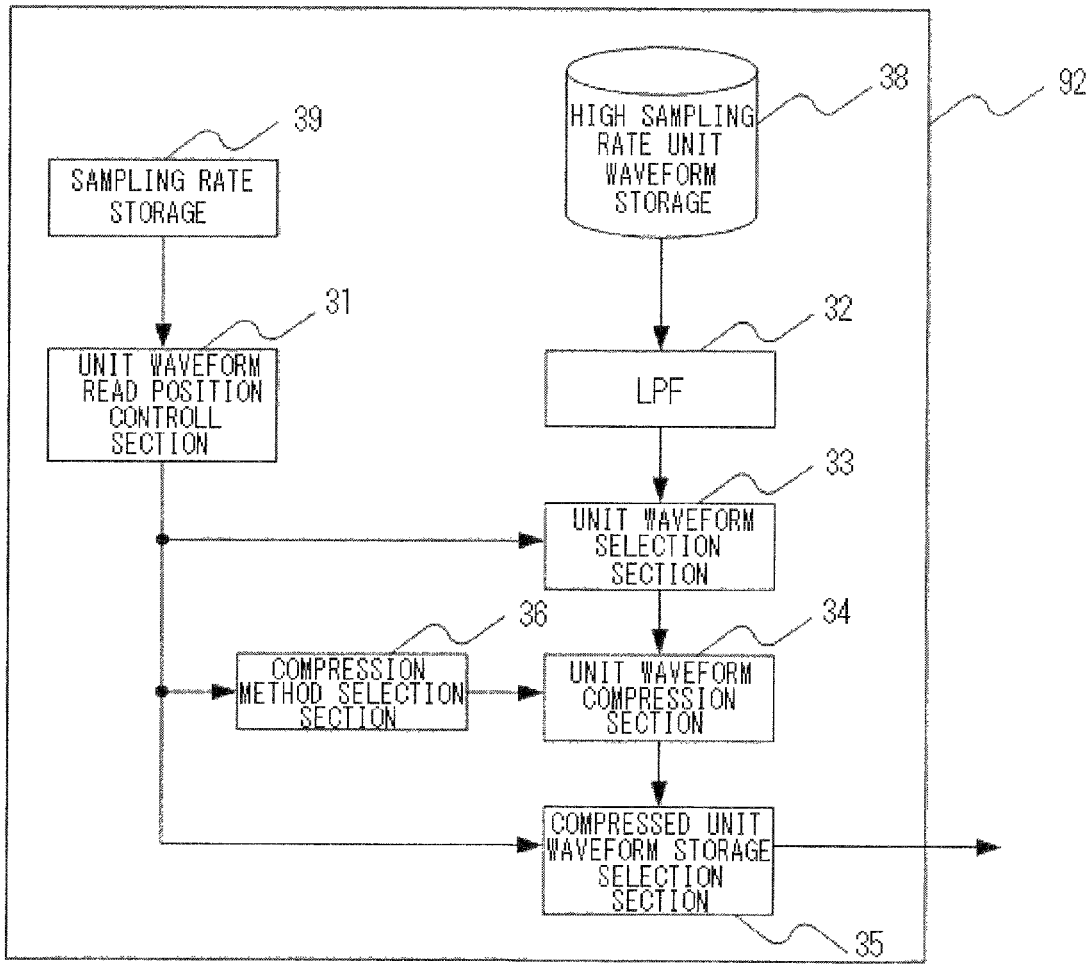
FIG. 9 is a block diagram showing the configuration of the compressed unit waveform storage generation section in the third embodiment of the present invention.
Figure 10:
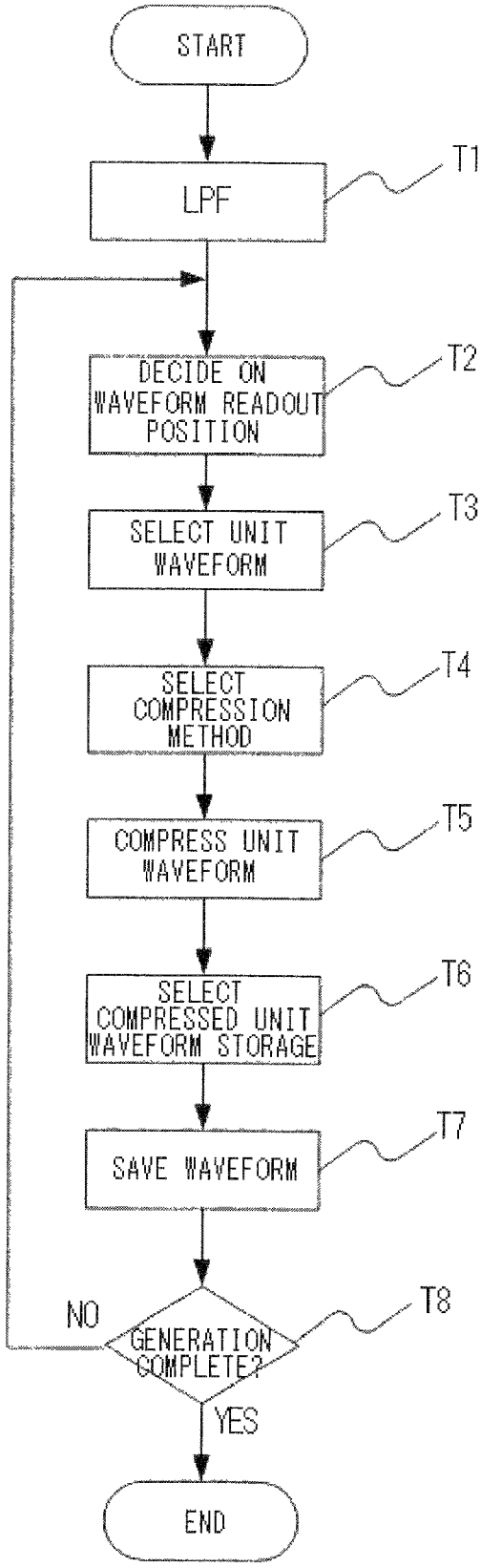
FIG. 10 is a flowchart for illustrating the operation of the compressed unit waveform storage generation section in the third embodiment of the present invention.

FIG. 8 depicts a diagram showing the configuration of the third example of the present invention. Referring to FIG. 8, showing the third example of the present invention, the unit waveform storage 6 and the compressed unit waveform storage generation section 91 of FIG. 3 are replaced by a compressed unit waveform storage generation section 92. That is, the manner of generating the compressed unit waveform storages differs from that of the above-described second example. The other elements are the same as those of the second example. The configuration and the operation of the compressed unit waveform storage generation section 92 of the third example of the present invention will now be described in detail. FIG. 9 depicts the configuration of the compressed unit waveform storage generation section 92 of FIG. 8, and FIG. 10 depicts a flowchart showing the operation of the third example of the present invention.

Referring to FIG. 9, the compressed unit waveform storage generation section 92 differs from the compressed unit waveform storage generation section 91 of FIG. 5 in that

- there is provided a high sampling rate unit waveform storage 38,
- the conversion ratio control section 20 of FIG. 5 is replaced by a sampling rate storage 39 and a unit waveform read position control section 31, and in that
- the sampling rate conversion section 21 and the unit waveform selection section 22 of FIG. 5 are replaced by an LPF 32 and a unit waveform selection section 33, respectively.

The details of the operation of the present example will now be described, mainly on these points of differences.

Referring to FIG. 9, showing the compressed unit waveform storage generation section 92, the high sampling rate unit waveform storage 38 is a database holding on memory a plurality of unit waveforms sampled at a sampling rate higher than that of the synthesized speech.

The sampling rates of the waveforms, registered in the high sampling rate unit waveform storage 38, are stored in the sampling rate storage 39.

The LPF (low pass filter) 32 has a passband which is the same frequency band as that of the synthesized speech. The high sampling rate unit waveforms, supplied from the high sampling rate unit waveform storage 38, are passed through the LPF 32 and thence transferred to the unit waveform selection section 33 (step T1 of FIG. 10).

The unit waveform read position control section 31 refers to the sampling rate, supplied from the sampling rate storage, to decide on a position of reading out, from the high sampling rate unit waveforms, the unit waveforms having the same sampling rate as that of the synthesized speech (step T2).

Since the compression rate of the unit waveforms differs with the read positions, the information on the unit waveform read positions is also transferred to a unit waveform compression section 34 and to a compressed unit waveform storage selection section 35.

The unit waveform selection section 33 samples, as it adjusts the waveform read position, the output waveform of the LPF 32 at a sampling width equal to that for the unit waveform, to generate a plurality of unit waveforms each having a different phase (step T3).

To associate storage numbers with the values of the conversion ratio, the waveform read position is determined based on the conversion ratio (storage number).

However, there may be cases where, from the relationship between the sampling rate of the high sampling rate unit waveform and the sampling rate of the unit waveform, the waveform read position, matched to the conversion ratio, is not located on an LPF output waveform.

It is thus checked whether or not the unit waveform may be generated at a corresponding conversion ratio from the ratio of a sampling rate ratio to the conversion ratio.

Let the sampling rate ratio (sampling rate of the high rate unit waveform to the sampling rate of the unit waveform) be C, and let the conversion ratio be K. Also, let K be a divisor of C. From the C/K'th, (C/K)*2nd, . . . , (C/K)*(K−1)st samples, the unit waveform selection section 33 reads waveforms on the LPF output waveform to generate K unit waveforms each having a different phase.

The unit waveform selection section supplies the K unit waveforms, each having a different phase, to the unit waveform compression section 34. Should there be any waveform(s) generated with the conversion ratio equal to or less than K−1, such waveform(s) are not transferred to the unit waveform compression section 34.

Except for operating responsive to the read position information, output from the unit waveform read position control section 31, the compressed unit waveform storage selection section 36, unit waveform compression section 34 and the compressed unit waveform storage selection section 35 operate equivalently to the compression method selection section 25, unit waveform compression section 23 and the compressed unit waveform storage selection section 24 of FIG. 5 respectively.

Referring to FIGS. 11A-11D, the processing procedure until generation of a plurality of the compressed unit waveform storages ($\mathbf{63}_1$ to $\mathbf{62}_k$ of FIG. 8) from the high sampling rate unit waveform processed by the LPF 32 (the processing from the step T2 up to the step T8 of FIG. 10) is now described.

Figures 11A, 11B, 11C, 11D:
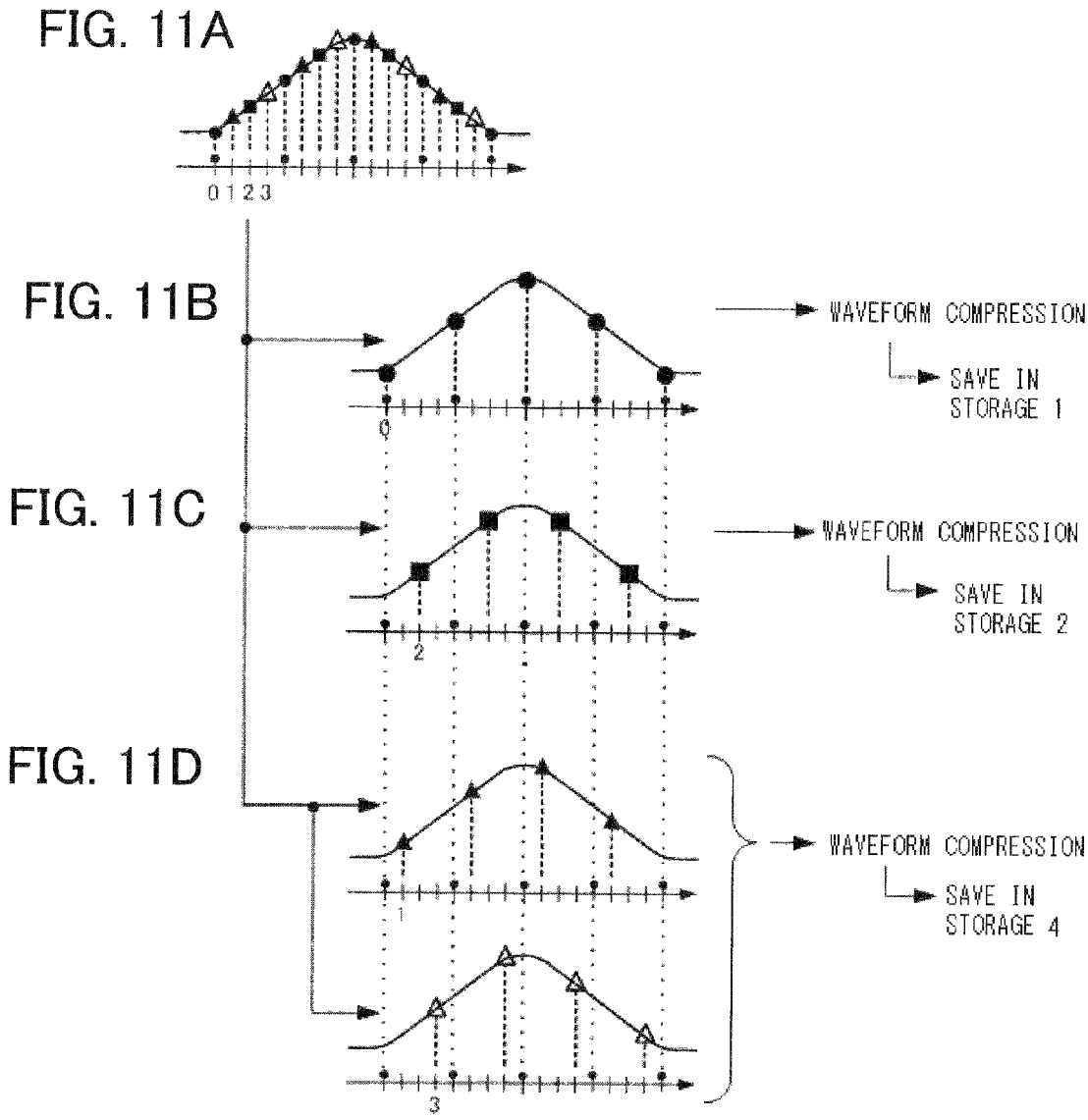
FIGS. 11A, 11B, 11C and 11D are waveform diagrams for illustrating the processing by the compressed unit waveform storage generation section in the third embodiment of the present invention.

FIG. 11A shows a unit waveform sampled at a rate four times that of the unit waveform used for synthesis. It should be noticed that this waveform has been processed by the LPF 32.

In this example, the sampling rate ratio is 4. Since the sampling is at a fourfold rate, the sampling interval for the unit waveform used for synthesis is four samples in FIG. 11A. Hence, the waveforms corresponding to the conversion ratio of 1 are those read out at a sampling interval of four samples from the zero read position, as shown in FIG. 11B (steps T2 and T3).

This waveform is compressed (steps T4 and T5) and registered in the storage 1, for example, in the compressed unit waveform storages $\mathbf{63}_1$ of FIG. 8 (steps T6 and T7).

Since the sampling rate ratio is divisible by 2, it is possible to read the waveforms corresponding to the twofold conversion ratio from the waveform of FIG. 11A.

The waveforms corresponding to the twofold conversion ratio are those read out from the read positions 0 and 2, as shown in FIGS. 11B and 11C. Since the waveform of FIG. 11B has been registered in the storage 1, only the waveform of FIG. 11C is compressed and saved in the storage 2 (for example, the compressed unit waveform storage $\mathbf{63}_2$ of FIG. 8).

Since the sampling rate ratio is not divisible with 3, it is not possible to read a waveform corresponding to the conversion ratio of 3 from the waveform of FIG. 11A. It is therefore not possible to create a storage for the waveform corresponding to the conversion ratio of 3.

Since the sampling rate ratio is divisible by four, it is possible to read the waveforms corresponding to the fourfold conversion ratio from the waveform of FIG. 11A. The waveforms corresponding to the fourfold conversion ratio are those read from the read positions 0, 2, 1 and 3, as shown in FIGS. 11B, 11C and 11D. Since the waveforms of FIGS. 11B and 11C are registered in the storages 1 and 2, respectively, only the two waveforms, shown in FIG. 11D, are compressed and saved in the storage 4, for example, in the compressed unit waveform storage $\mathbf{63}_4$.

It is seen from FIGS. 7A-7H and 11A-11D that the waveforms of FIG. 7E and FIG. 11B are of the same phase, while the waveforms of FIG. 7F and FIG. 11C are of the same phase. The same is valid for FIG. 7H and FIG. 11D.

In short, changing the conversion ratio in the above-described second example is tantamount to changing the read position in the third example of the present invention.

With the example that uses the compressed unit waveform storages, it is unnecessary to change the sampling rate in the course of speech synthesis, thus allowing reduction of the amount of computation in the course of speech synthesis.

On the other hand, with the example which carries out the sampling rate conversion in the course of speech synthesis, only a single storage for the unit waveform information suffices. Hence, it becomes possible to reduce the storage capacity as compared to the method of using a plurality of the compressed unit waveform storages.

Thus, if the method of using the compressed unit waveform storages and the method of converting the sampling rate in the course of speech synthesis are combined together, it becomes possible to effect speech synthesis with the small capacity of the unit waveform storage, as the amount of computation necessary for sampling rate conversion is suppressed from increasing.

In the present example, the compressed unit waveform storage generation section 92 may be implemented by a program as run on a computer.

Figure 13:
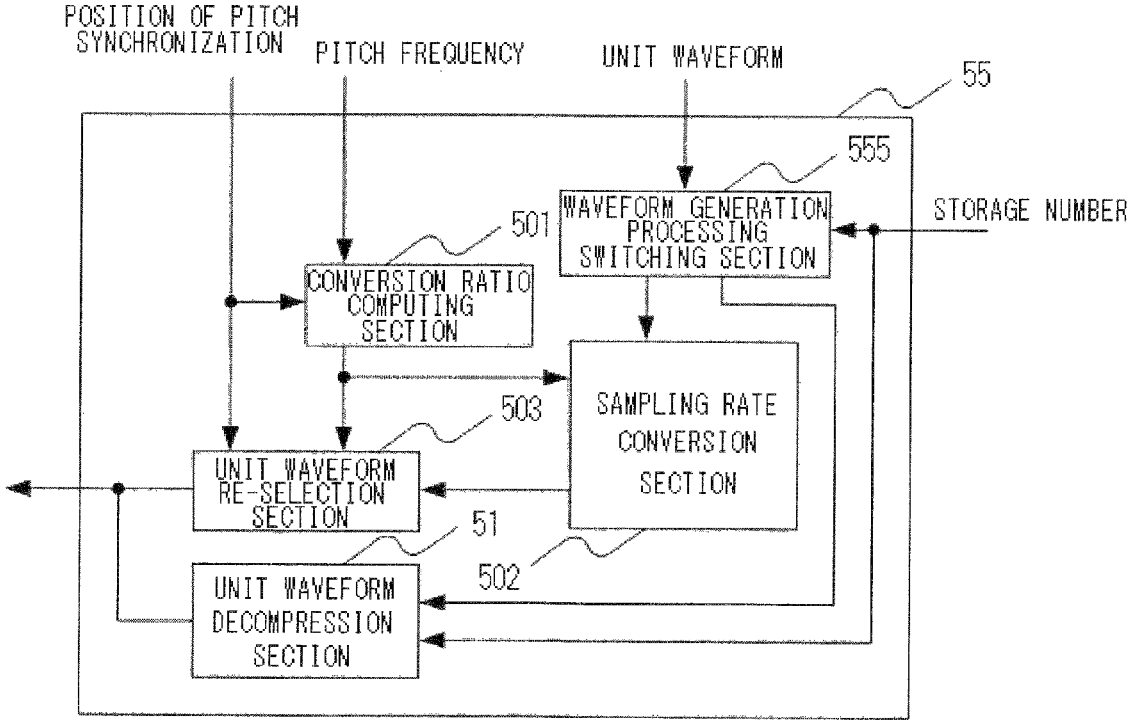
FIG. 13 is a block diagram showing the configuration of a unit waveform storage generation section in the fourth embodiment of the present invention.
Figure 14:
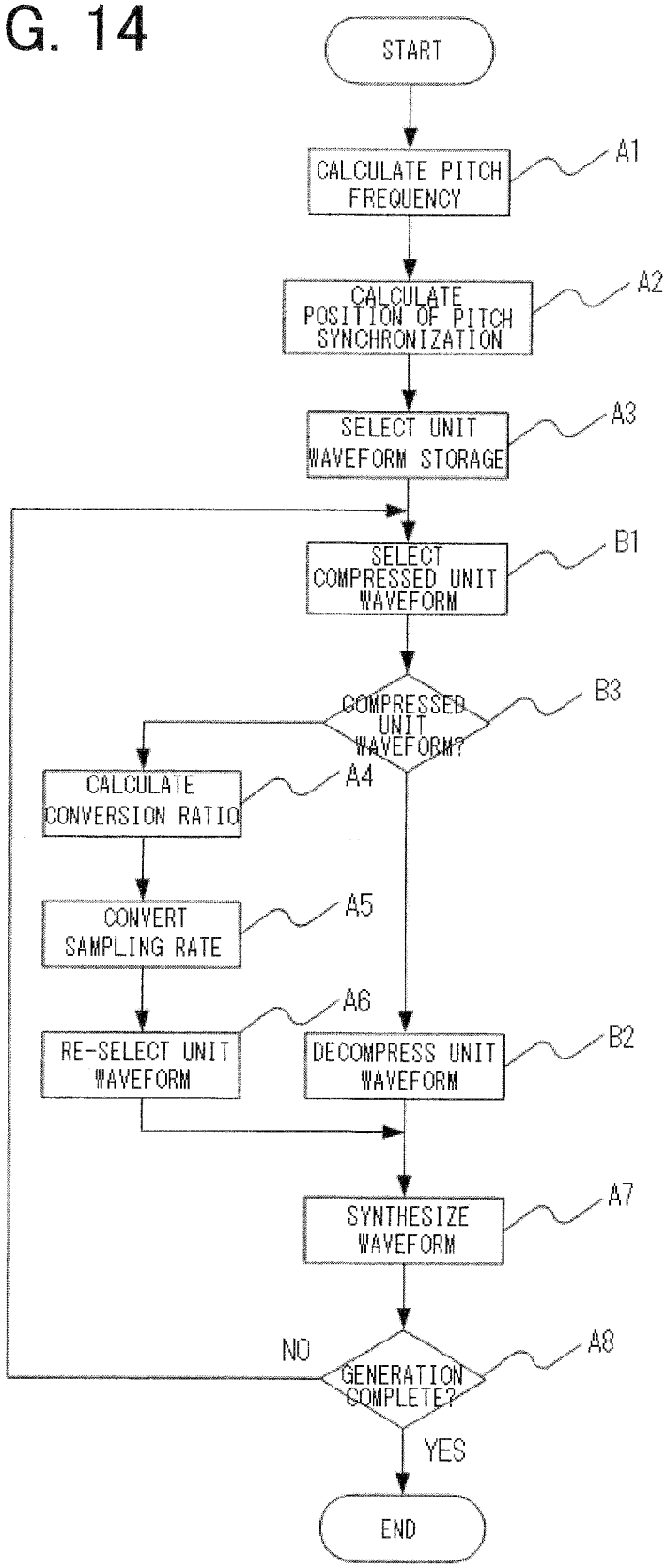
FIG. 14 is a flowchart for illustrating the operation of the fourth embodiment of the present invention.

A fourth example, which is a combination of a method employing a compressed unit waveform storage and a method which performs the sampling rate conversion in the course of synthesis, is now described with reference to FIGS. 12 to 14.

Fourth Embodiment

In the fourth example of the present invention, a unit waveform is generated, using a sampling rate conversion system, in case of a high conversion ratio. If the conversion ratio is low, the unit waveform, stored in the compressed unit waveform storage, is used.

Figure 12:
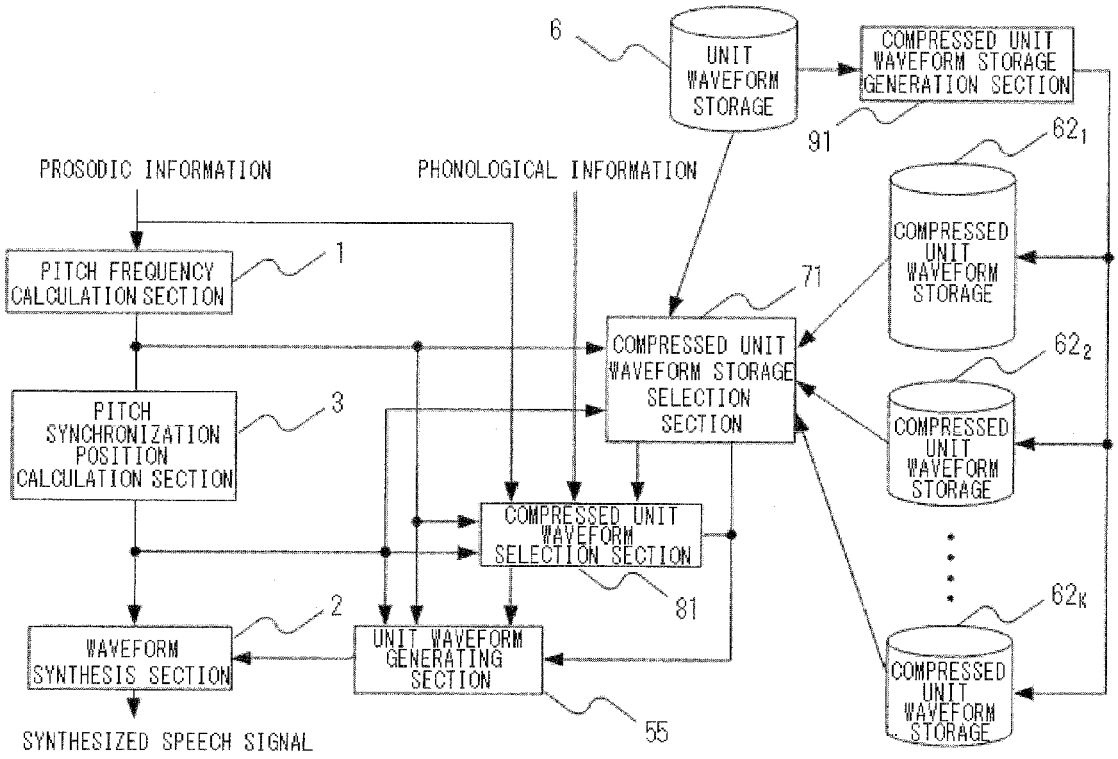
FIG. 12 is a block diagram showing the configuration of a fourth embodiment of the present invention.

FIG. 12 shows the configuration of the fourth example of the present invention. FIG. 14 depicts a flowchart for illustrating the operation of the fourth example of the present invention. The example shown in FIG. 12 differs from that of FIG. 3 in that the unit waveform storage selection section 7 is replaced by a unit waveform storage selection section 71, the compressed unit waveform selection section 8 is replaced by a compressed unit waveform selection section 81 and in that the unit waveform decompression section 51 is replaced by a unit waveform generation section 55. The details of the operation will now be described mainly on these points of differences.

The unit waveform storage selection section 71 selects one of the compressed unit waveform storages $\mathbf{62}_1$, $\mathbf{62}_2$, . . . , $\mathbf{62}_k$ and the unit waveform storage 6, based on the pitch frequency supplied from the pitch frequency calculation section 1 and on the position of pitch synchronization supplied from the pitch synchronization position calculation section 3. The unit waveform storage selection section then delivers the unit waveform information, registered in the storage selected, to the compressed unit waveform selection section 81, while delivering the selected storage number to the unit waveform generation section 55 (step A3 of FIG. 14).

As with the unit waveform storage selection section 7, the unit waveform storage selection section 71 calculates the conversion ratio, from the position of pitch synchronization and the pitch frequency, and selects the storage from the so computed conversion ratio. In case of a high conversion ratio, the unit waveform storage 6 is selected and the sampling rate is converted in the unit waveform generation section 55.

In case of a low conversion ratio, one of the compressed unit waveform storages $\mathbf{62}_1$, $\mathbf{62}_2$, . . . , $\mathbf{62}_k$ is selected, by a method as in the unit waveform storage selection section 7, and decompression to the unit waveform is carried out by the unit waveform generation section 55.

The compressed unit waveform selection section 81 selects one of the unit waveforms, registered in the storage as selected in the unit waveform storage selection section 71, based on the prosodic information, phonological information, pitch frequency supplied from the pitch frequency calculation section 1 and on the position of pitch synchronization, supplied from the pitch synchronization position calculation section 3. The compressed unit waveform selection section then delivers the selected waveform to the unit waveform generation section 55 (step B1).

In case the unit waveform storage selection section 71 has not selected the unit waveform storage 6, the compressed unit waveform selection section finds the phase from the position of pitch synchronization, and selects the compressed unit waveform as the phase is taken into account.

In case the unit waveform storage selection section has selected the unit waveform storage 6, the compressed unit waveform selection section selects the unit waveform without taking the phase into account. The unit waveform generation section 55 is now explained with reference to FIG. 13, showing the configuration of the unit waveform generation section 55 of FIG. 12. Referring to FIG. 13, the unit waveform generation section 55 differs from a unit waveform generation section 50 shown in FIG. 1 in that the former includes a waveform generation processing switching section 555 and the unit waveform decompression section 51.

The unit waveform decompression section 51 is the same as the unit waveform decompression section 51 described above with reference to FIG. 3. The details of the operation will now be described mainly on the above points of differences.

The waveform generation processing switching section 555 determines, from the storage number supplied from the unit waveform storage selection section 71 of FIG. 12, whether the unit waveform, supplied from the compressed unit waveform selection section 81 of FIG. 12, is a compressed waveform or a non-compressed waveform, to select the output destination of the unit waveform. If the non-compressed waveform is entered, the switching section 555 outputs the unit waveform to the sampling rate conversion section 502 (step B3 of FIG. 14).

If the compressed waveform is entered, the switching section 555 outputs the unit waveform to the unit waveform decompression section 51.

That is, when the non-compressed waveform is entered, the unit waveform generation section 55 generates unit waveforms by sampling rate conversion, as in the above-described first example (steps A4 to A6).

On the other hand, if the compressed unit waveform is entered, the compressed unit waveform is decompressed, as in the above-described second example, to generate a unit waveform (step B2).

The above description has been directed to methods and apparatus for connecting the unit waveforms to generate the synthesized speech.

The configurations of the first to fourth examples may also be applied to methods and apparatus for generating the synthesized speech by entering a sound source signal to a vocal tract filter which has modeled the vocal tract of the human being. An example directed to methods and apparatus for generating the synthesized speech by entering a sound source signal to the vocal tract filter will now be described.

In the following, an example in which the above-described first and second examples are applied to generate the sound source signal is described.

Fifth Embodiment

Figure 15:
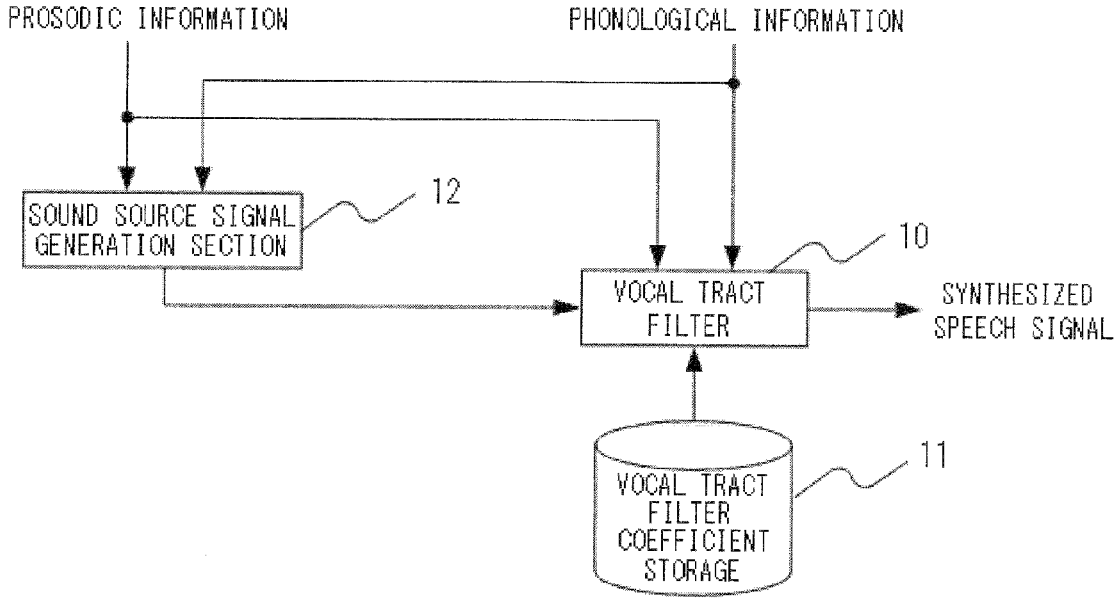
FIG. 15 is a block diagram of a fifth embodiment of the present invention.

FIG. 15 shows the configuration of a fifth example of the present invention. Referring to FIG. 15, the fifth example of the present invention includes a vocal tract filter 10, a vocal tract filter coefficient storage 11 and a sound source signal generation section 12.

The sound source signal generation section 12 generates a sound source signal, based on the prosodic information and the phonological information, and supplies the so generated signal to the vocal tract filter 10.

The vocal tract filter 10 selects, based on the prosodic information and the phonological information, the vocal tract filter coefficients, optimum for generating the synthesized speech, out of the vocal tract filter coefficients registered in the vocal tract filter coefficient storage 11.

The so selected vocal tract filter coefficients are convolved on the sound source signal, supplied from the sound source signal generation section 12, to generate a synthesized speech signal. The details of the configuration and the operation of the sound source signal generation section 12 are now described with reference to FIG. 16.

Figure 16:
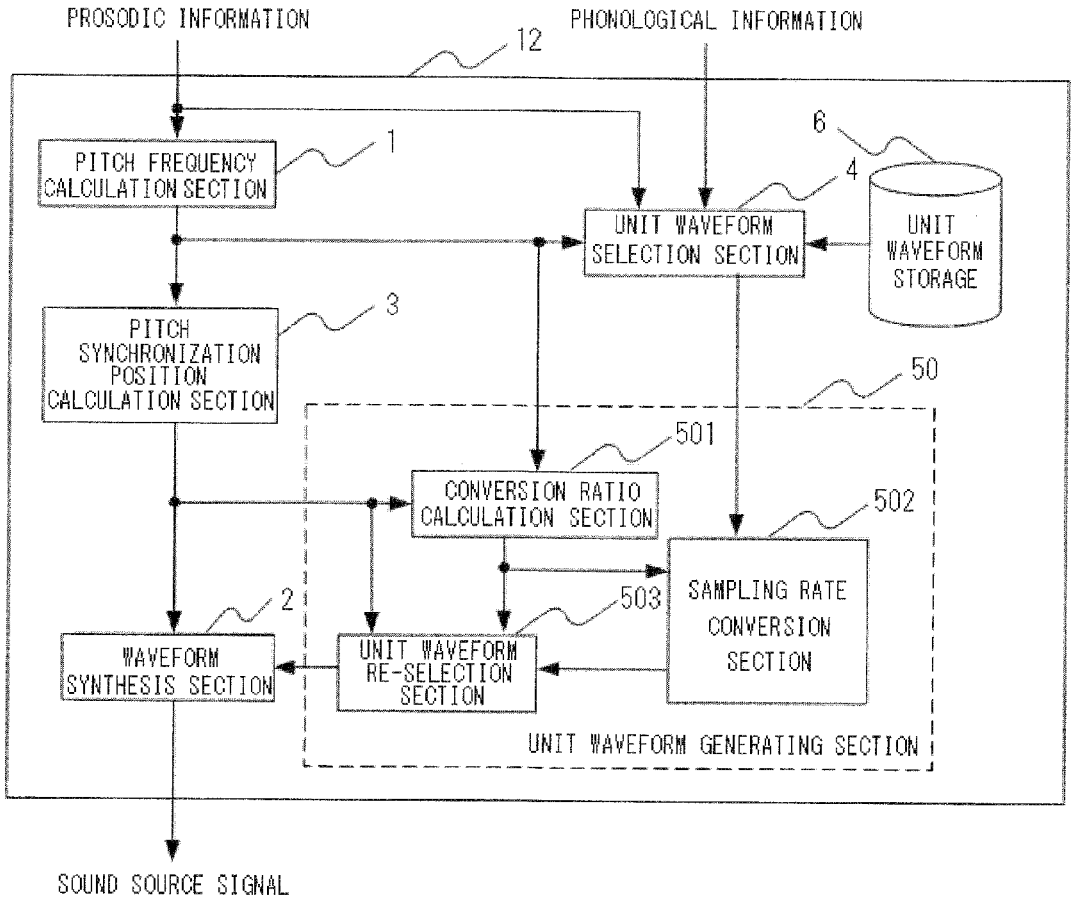
FIG. 16 is a block diagram of a sound source signal generation section in the fifth embodiment of the present invention.

FIG. 16 depicts a block diagram showing the configuration of the sound source signal generation section 12 of FIG. 15. FIG. 16 differs from FIG. 1, showing the above-described first example, in that the unit waveform registered in the unit waveform storage 6 is not a waveform extracted from the natural speech, but is a waveform directly extracted from the sound source signal to a proper length; and in that the output signal of the waveform synthesis section 2 is not a synthesized speech signal but is a sound source signal. The operations of the respective blocks are the same as those of the above-described first example.

The present example is a modification of the first example. It may also be a modification of the second example.

An example in which the above described second example is applied to the sound source generation section is now described.

Sixth Embodiment

Figure 17:
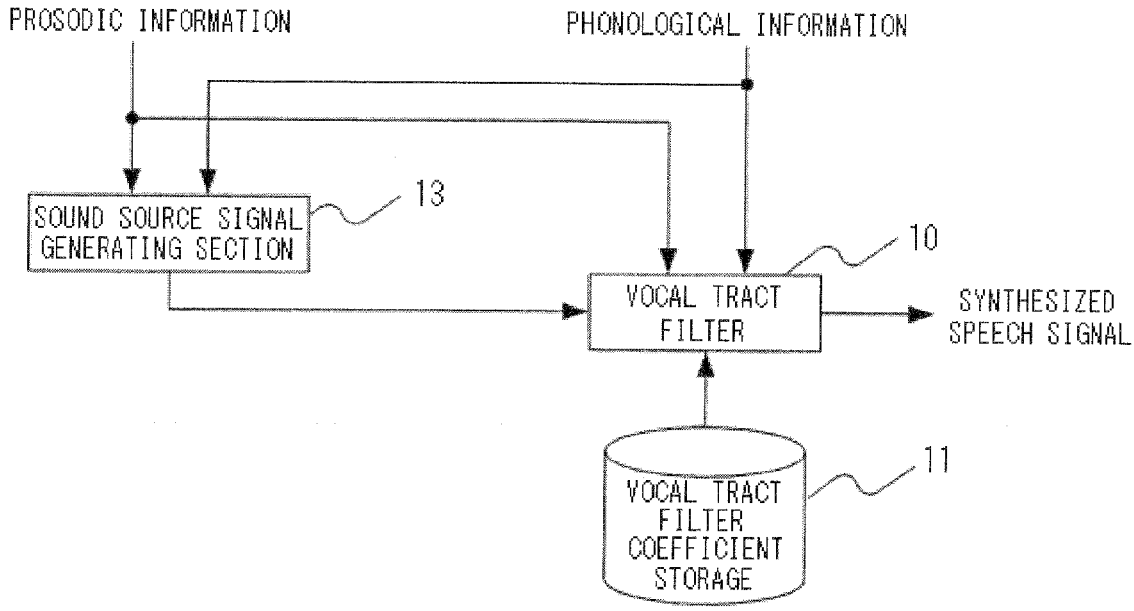
FIG. 17 is a block diagram showing the configuration of a sixth embodiment of the present invention.

FIG. 17 shows the configuration of a sixth example of the present invention. The present example differs from the fifth example, described with reference to FIG. 15, in that the sound source signal generation section 12 of FIG. 15 is replaced by a sound source signal generation section 13 of FIG. 17. That is, the present example differs from the fifth example only as to the configuration of the sound source signal generation section 13.

The details of the configuration and the operation of the sound source signal generation section 13 in the sixth example of the present invention will now be described with reference to FIG. 18.

Figure 18:
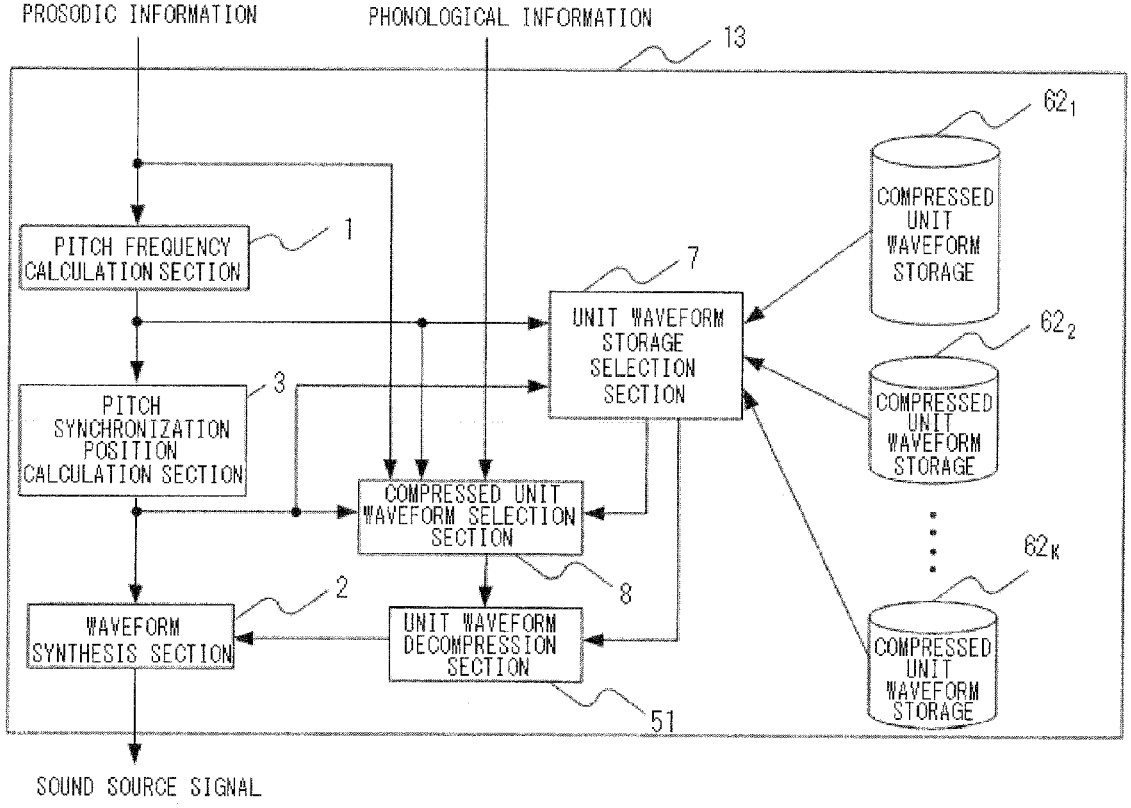
FIG. 18 is a block diagram showing the configuration of a sound source generation section of the sixth embodiment of the present invention.

FIG. 18 shows the configuration of the sound source signal generation section 13 of FIG. 17. Referring to FIG. 18, the present example differs from the second example, described with reference to FIG. 3, in that the unit waveforms, registered in the compressed unit waveform storages $\mathbf{62}_1$, $\mathbf{62}_2$, . . . , $\mathbf{62}_k$, are not derived from the natural speech, but are waveforms directly extracted to proper lengths from the sound source signal, and in that the signal output from the waveform synthesis section 2 is not the synthesized speech signal but is a sound source signal. The operation of each block is the same as that of the above-described second example.

In the above-described first example, the conversion ratio calculation section 501 calculates an optimum Conversion ratio, matched to the pitch frequency and the position of pitch synchronization, based on the pitch frequency and the position of pitch synchronization. Or, the conversion ratio calculation section may be replaced by e.g. the lookup table system. This arrangement is now described as a seventh example.

Seventh Embodiment

Figure 19:
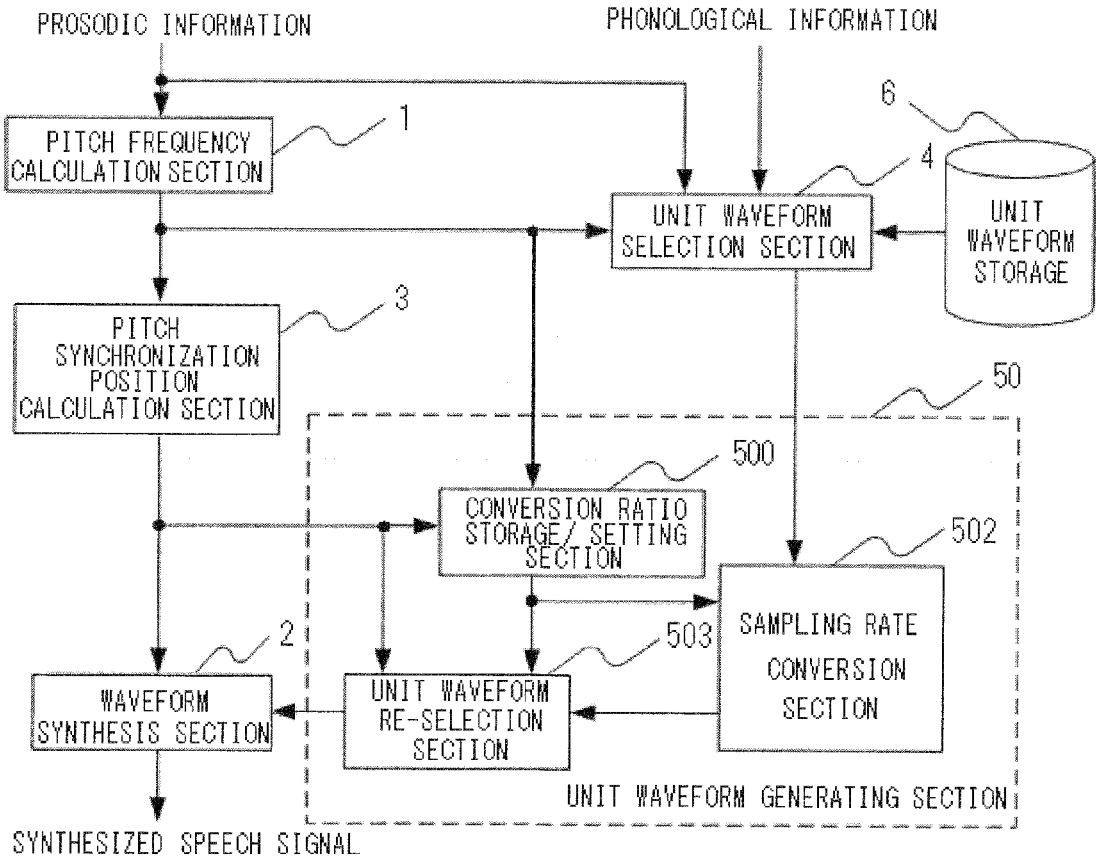
FIG. 19 is a block diagram showing the configuration of a seventh embodiment of the present invention.

FIG. 19 shows the configuration of the seventh example of the present invention. The present example includes a conversion ratio storage/setting section 500 holding the sampling rate conversion ratio on memory from the outset. The conversion ratio storage/setting section 500 includes e.g. the storage (lookup table) and outputs a sampling rate conversion ratio to the sampling rate conversion section 502 and the unit waveform re-selection section 503. The sampling rate conversion ratio, thus output, is matched to the pitch frequency and the position of pitch synchronization, calculated by the pitch frequency calculation section 1 and the pitch synchronization position calculation section 3, respectively. Though no limitation is imposed on the present invention, the addresses of the storages of the conversion ratio storage/setting section 500 are allocated in register with domains of widths of values assumed by the pitch frequency and the position of pitch synchronization. The addresses associated with the domains including the values (floating point) of the pitch frequency and the position of pitch synchronization, are found, and the values of the sampling rate conversion ratio associated with the addresses are read out. The contents of the storage (lookup table) of the conversion ratio storage/setting section 500 may variably be set from outside.

In the present example, the conversion ratio is determined based on the pitch frequency and the position of pitch synchronization. Alternatively, the conversion ratio may be determined by controlling the conversion ratio storage/setting section 500 from outside the speech synthesis apparatus, as in the modification of the first example described above. If it is necessary to control the computational load of the entire system, having the built-in speech synthesizing apparatus, it is effective to control the conversion ratio from outside the speech synthesis apparatus. If the conversion ratio is reduced, the amount of computation of the speech synthesis apparatus is decreased. If desired to decrease the computational load of the entire system, the conversion ratio may be made smaller to contribute to decreasing the computational load of the speech synthesis apparatus. On the other hand, if there is certain allowance in the computational load of the entire system, and the amount of computation of the speech synthesis apparatus may safely be increased, the conversion ratio may be increased to improve the sound quality of the synthesized speech.

Figure 20:
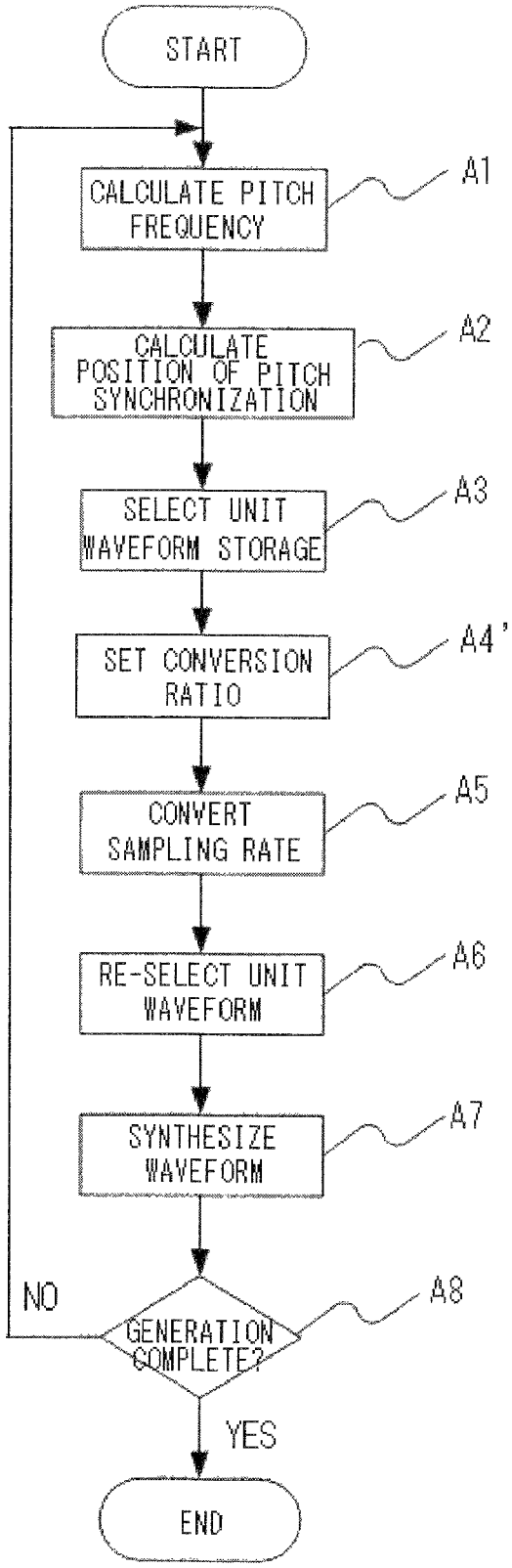
FIG. 20 is a flowchart for illustrating the operation of the seventh embodiment of the present invention.
Figure 21A:
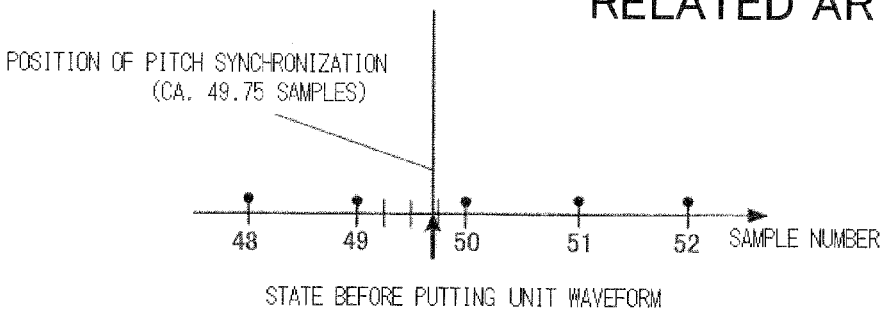
FIG. 21A RELATED ART
FIGS. 21A, 21B, 21C, 21D and 21E are waveform diagrams for illustrating the processing of a conventional technique for speech synthesis.
Figure 21B:
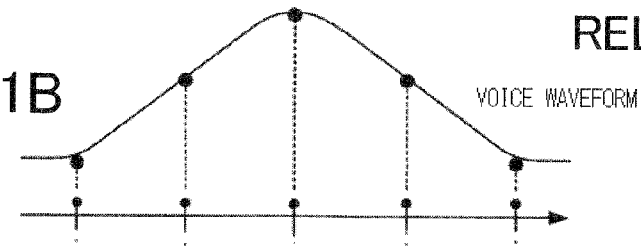
FIG. 21B RELATED ART
Figure 21C:
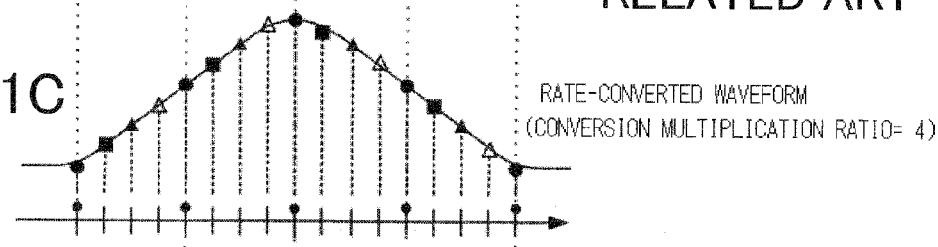
FIG. 21C RELATED ART
Figure 21D:
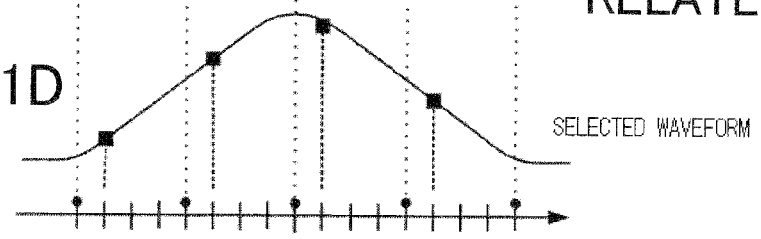
FIG. 21D RELATED ART
Figure 21E:
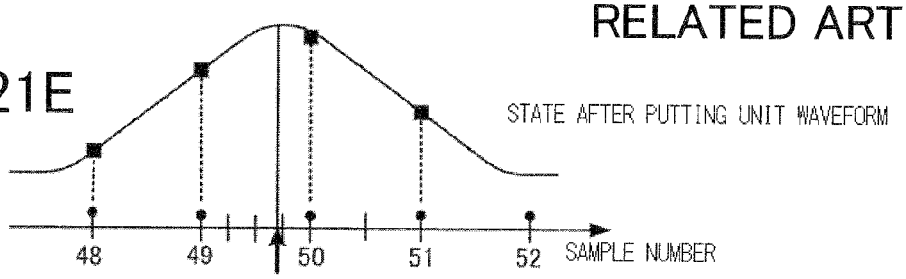
FIG. 21E RELATED ART

FIG. 20 depicts a flowchart for illustrating the operation of the present example. This flowchart is basically the same as that of FIG. 2. However, in FIG. 20, the conversion ratio storage/setting section 500 outputs, in a step A4', the sampling rate conversion ratio, matched to the pitch frequency and to the position of pitch synchronization, supplied from the pitch frequency calculation section 1 and the pitch synchronization position calculation section 3, respectively, and supplies them to the sampling rate conversion section 502 and to the unit waveform re-selection section 503. The remaining steps are the same as those of FIG. 2.

Although the present invention has so far been described with reference to preferred examples, the present invention is not to be restricted to the examples. It is to be appreciated that those skilled in the art can change or modify the examples without departing from the spirit and the scope of the present invention.

The invention claimed is:

1. A speech synthesis apparatus for concatenating a plurality of unit waveforms to generate synthesized speech, said apparatus comprising:

a conversion section that converts a sampling rate of said unit waveform;

a decimation section that decimates the unit waveform that undergoes the conversion of the sampling rate to the sampling rate of a synthesized speech; and a waveform synthesis section that generates the synthesized speech using the decimated unit waveform, wherein said conversion section changes a conversion ratio of the sampling rate based on input prosodic information, wherein said conversion section derives a pitch frequency from the prosodic information and increases a value of said conversion ratio to a higher value when the pitch frequency is of a relatively high value, wherein said conversion section derives a position of pitch synchronization from said pitch frequency and uses the value of the conversion ratio which relatively reduces an error in the position of pitch synchronization, wherein the error is the difference between the position of pitch synchronization as found by a pitch synchronization position calculation section and a waveform center position of the waveform as selected out of sampling-rate-converted unit waveforms.

2. A speech synthesis apparatus comprising:

a plurality of compressed unit waveform storages which store a plurality of compressed unit waveforms in association with a conversion ratio of a sampling rate;

a compressed unit waveform storage selection section that selects one of said compressed unit waveform storages, based on input prosodic information;

a compressed unit waveform selection section that selects the compressed unit waveform from the selected one of said compressed unit waveform storage, based on said prosodic information and phonological information;

a unit waveform decompression section that decompresses said compressed unit waveform to obtain the unit waveform, based on identification information of the selected compressed unit waveform storage;

a waveform synthesis section that generates the synthesized speech based on said prosodic information and the decompressed unit waveform;

a unit waveform storage that stores at least one unit waveform; and a compressed unit waveform storage generation section that generates, out of the unit waveform in said unit waveform storage, a unit waveform that has a sampling-rate thereof converted to a sampling rate different from the sampling rate of said unit waveform, compresses the generated sampling-rate-converted unit waveform and stores the compressed sampling-rate-converted unit waveform in said compressed unit waveform storage corresponding to the sampling rate conversion ratio, wherein said compressed unit waveform storage generation section includes:

a sampling rate conversion section that generates, from said unit waveform, a unit waveform that has a sampling-rate thereof converted to a sampling rate different from the sampling rate of said unit waveform;

a unit waveform selection section that finds a plurality of unit waveforms, each having a different phase, from said sampling-rate-converted unit waveform; and a unit waveform compression section that compresses a plurality of said unit waveforms, each having a different phase, to generate a plurality of compressed unit waveforms.

3. A speech synthesis apparatus comprising:

a plurality of compressed unit waveform storages which store a plurality of compressed unit waveforms in association with conversion ratio of a sampling rate;

a compressed unit waveform storage selection section that selects one of said compressed unit waveform storages, based on input prosodic information;

a compressed unit waveform selection section that selects the compressed unit waveform from the selected one of said compressed unit waveform storage, based on said prosodic information and phonological information;

a unit waveform decompression section that decompresses said compressed unit waveform to obtain the unit waveform, based on identification information of the selected compressed unit waveform storage;

a waveform synthesis section that generates the synthesized speech based on said prosodic information and the decompressed unit waveform;

a unit waveform storage that stores at least one unit waveform;

a compressed unit waveform storage generation section that generates, out of the unit waveform in said unit waveform storage, a unit waveform that has a sampling-rate thereof converted to a sampling rate different from the sampling rate of said unit waveform, compresses the generated sampling-rate-converted unit waveform and stores the compressed sampling-rate-converted unit waveform in said compressed unit waveform storage corresponding to the sampling rate conversion ratio; and a compression method selection section that decides on a method for compression in accordance with the phase of the unit waveform.

4. A speech synthesis apparatus comprising:

a plurality of compressed unit waveform storages which store a plurality of compressed unit waveforms in association with conversion ratio of a sampling rate;

a compressed unit waveform storage selection section that selects one of said compressed unit waveform storages, based on input prosodic information;

a compressed unit waveform selection section that selects the compressed unit waveform from the selected one of said compressed unit waveform storage, based on said prosodic information and phonological information;

a unit waveform decompression section that decompresses said compressed unit waveform to obtain the unit waveform, based on identification information of the selected compressed unit waveform storage;

a waveform synthesis section that generates the synthesized speech based on said prosodic information and the decompressed unit waveform; and a compressed unit waveform storage generation section that generates compressed unit waveforms, stored in a plurality of said compressed unit waveform storages, from a speech waveform having the sampling rate higher than the sampling rate of said unit waveform, wherein said compressed unit waveform storage generation section includes:

a unit waveform selection section that finds a plurality of unit waveforms, each having a different phase, from a speech waveform, having a sampling rate higher than the sampling rate of a unit waveform; and a unit waveform compression section that compresses said unit waveforms, each having a different phase, to generate a plurality of compressed unit waveforms.

5. The speech synthesis apparatus according to claim 4, wherein said unit waveform compression section includes a compression method selection section that selects a method for compression based on a ratio of the sampling rate of said sampling-rate-converted unit waveform to the sampling rate of said unit waveform.

6. A speech synthesis apparatus comprising:

a plurality of compressed unit waveform storages which store a plurality of compressed unit waveforms in association with conversion ratio of a sampling rate;

a compressed unit waveform storage selection section that selects one of said compressed unit waveform storages, based on input prosodic information;

a compressed unit waveform selection section that selects the compressed unit waveform from the selected one of said compressed unit waveform storage, based on said prosodic information and phonological information;

a unit waveform decompression section that decompresses said compressed unit waveform to obtain the unit waveform, based on identification information of the selected compressed unit waveform storage; and a waveform synthesis section that generates the synthesized speech based on said prosodic information and the decompressed unit waveform, wherein, when a non-compressed unit waveform is selected, a unit waveform is generated by sampling rate conversion and, when a compressed unit waveform is input, the compressed unit waveform is decompressed by said unit waveform decompression section to generate a unit waveform.

7. A speech synthesis apparatus comprising:

a plurality of compressed unit waveform storages which store a plurality of compressed unit waveforms in association with conversion ratio of a sampling rate;

a compressed unit waveform storage selection section that selects one of said compressed unit waveform storages, based on input prosodic information;

a compressed unit waveform selection section that selects the compressed unit waveform from the selected one of said compressed unit waveform storage, based on said prosodic information and phonological information;

a unit waveform decompression section that decompresses said compressed unit waveform to obtain the unit waveform, based on identification information of the selected compressed unit waveform storage;

a waveform synthesis section that generates the synthesized speech based on said prosodic information and the decompressed unit waveform;

a unit waveform storage that stores a variety of unit waveforms needed for generating the synthesized speech and attribute information of the unit waveforms;

a compressed unit waveform storage generation section that processes and compresses the unit waveforms supplied from said unit waveform storage and that stores the compressed unit waveforms in the compressed unit waveform storage selected out of a plurality of said compressed unit waveform storages;

a pitch frequency calculation section that computes the pitch frequency from the prosodic information;

a pitch synchronization position calculation section that computes position of pitch synchronization, based on the pitch frequency supplied from said pitch frequency calculation section; and a compressed unit waveform storage selection section that computes a sampling rate conversion ratio, based on the pitch frequency supplied from the pitch frequency calculation section and on the position of pitch synchronization supplied from said pitch synchronization position calculation section, and selects the compressed unit waveform storage matched to the computed conversion ratio, wherein said compressed unit waveform selection section selects one of the compressed unit waveforms registered in the compressed unit waveform storage selected by said compressed unit waveform storage selection section, based on prosodic information, phonological information, pitch information supplied from said pitch frequency calculation section and the position of pitch synchronization supplied from said pitch synchronization position calculation section;

said unit waveform decompression section decompresses the compressed unit waveform supplied from said compressed unit waveform selection section into a unit waveform; and said waveform synthesis section places and connects unit waveforms supplied from a unit waveform re-selection section on the position of pitch synchronization supplied from said pitch synchronization position calculation section to synthesize a waveform; said waveform synthesis section outputting a synthesized speech signal.

8. The speech synthesis apparatus according to claim 7, wherein said compressed unit waveform storage generation section includes:

a conversion ratio control section that outputs a plurality of values of the conversion ratio for a sole unit waveform supplied to said compressed unit waveform storage generation section;

a sampling rate conversion section that converts, with the conversion ratio supplied from said conversion ratio control section, the sampling rate of the sole unit waveform supplied;

a unit waveform selection section that selects the unit waveform having the phase unregistered in said compressed unit waveform storage, out of the sampling-rate-converted unit waveforms generated by said sampling rate conversion section, as said unit waveform selection section references the conversion ratio supplied from said conversion ratio control section;

a compression method selection section that decides on a method for compression, by referencing the conversion ratio supplied from said conversion ratio control section, and outputs information on the method for compression;

a unit waveform compression section that compresses the unit waveform, supplied from said unit waveform selection section, based on the information on the compression method selected by said compression method selection section, and outputs the compressed unit waveform to the compressed unit waveform storage selection section; and a compressed unit waveform storage selection section that selects one of a plurality of said compressed unit waveform storages, by referencing the conversion ratio supplied from said conversion ratio control section, and outputs the compressed unit waveform, supplied from said unit waveform compression section, to said compressed unit waveform storage selected.

9. A speech synthesis apparatus comprising:

a plurality of compressed unit waveform storages which store a plurality of compressed unit waveforms in association with conversion ratio of a sampling rate;

a compressed unit waveform storage selection section that selects one of said compressed unit waveform storages, based on input prosodic information;

a compressed unit waveform selection section that selects the compressed unit waveform from the selected one of said compressed unit waveform storage, based on said prosodic information and phonological information;

a unit waveform decompression section that decompresses said compressed unit waveform to obtain the unit waveform, based on identification information of the selected compressed unit waveform storage;

a waveform synthesis section that generates the synthesized speech based on said prosodic information and the decompressed unit waveform; and a compressed unit waveform storage generation section that generates compressed unit waveforms, stored in a plurality of said compressed unit waveform storages, from a speech waveform having the sampling rate higher than the sampling rate of said unit waveform, wherein said compressed unit waveform storage generation section includes:

a high sampling rate unit waveform storage that stores a unit waveform sampled at a sampling rate higher than the sampling rate for the synthesized speech;

a sampling rate storage that stores the sampling rate of a unit waveform registered in said high sampling rate unit waveform storage;

a filter that receives the high sampling rate unit waveform, supplied from said high sampling rate unit waveform storage, said filter having a passband which is a same band as that for the synthesized speech;

a unit waveform read position control section that decides on a position for reading the unit waveform having the same sampling rate as the sampling rate for the synthesized speech, from the high sampling rate unit waveform, by referencing the sampling rate stored in said sampling rate storage;

a unit waveform selection section that adjusts the waveform read position of an output waveform of said filter, and samples said output waveform with the same sampling width as the sampling width of said unit waveform to generate a plurality of unit waveforms each having a different phase;

a compression method selection section that decides on a method for compression, depending on the read position information output from said unit waveform read position control section, to output the information on the method for compression;

a unit waveform compression section that compresses the unit waveform, supplied from said unit waveform selection section, based on the information on the compression method selected by said compression method selection section, to output the compressed unit waveform; and a compressed unit waveform storage selection section that selects one of a plurality of said compressed unit waveform storages, depending on the read position information output from said unit waveform read position control section, and outputs the compressed unit waveform, supplied from said unit waveform compression section, to said compressed unit waveform storage.

10. The speech synthesis apparatus according to claim 7, further comprising:

a conversion ratio computing section that decides on the sampling rate conversion ratio, based on the pitch frequency supplied from said pitch frequency calculation section, and on the position of pitch synchronization supplied from said pitch synchronization position calculation section;

a sampling rate conversion section that generates, from the unit waveform supplied from said unit waveform selection section, a unit waveform, the sampling rate of which has been converted to a value different from the sampling rate of said unit waveform, in accordance with the conversion ratio supplied from said conversion ratio computing section;

a unit waveform re-selection section that selects a unit waveform, out of the sampling-rate-converted unit waveforms, supplied from said sampling rate conversion section, based on the position of pitch synchronization supplied from said pitch synchronization position calculation section; and a waveform generation processing switching section that determines, based on the identification information for the unit waveform storage, selected by said unit waveform storage selection section, whether the unit waveform supplied from said compressed unit waveform selection section is a compressed waveform or a non-compressed waveform; said waveform generation processing switching section outputting a unit waveform to said sampling rate conversion section if a non-compressed waveform is entered as an input; said waveform generation processing switching section outputting a compressed unit waveform to said unit waveform decompression section, if a compressed waveform is entered as an input.

11. A speech synthesis method for concatenating a plurality of unit waveforms to generate synthesized speech; said method comprising:

a step of performing conversion that increases sampling rate of said unit waveform;

a step of decimating the unit waveform that undergoes the conversion of the sampling rate to the sampling rate of a synthesized speech; and a step of generating the synthesized speech using the decimated unit waveform, wherein said step of performing conversion changes a conversion ratio of the sampling rate based on input prosodic information, wherein said step of performing the conversion finds pitch frequency from the prosodic information and increases a value of said conversion ratio to a higher value in case of a higher value of the pitch frequency, wherein said step of performing the conversion finds position of pitch synchronization from said pitch frequency and uses the value of the conversion ratio which reduces an error in the position of pitch synchronization to a smaller value, wherein the error is the difference between the position of pitch synchronization as found by a pitch synchronization step and a waveform center position of the waveform as selected out of sampling-rate-converted unit waveforms.

12. A computer constituting a speech synthesis apparatus performs processing of concatenating unit waveforms to generate a synthesized speech, comprising:

the computer programmed to perform:

a process of performing conversion that increases sampling rate of said unit waveform and changes a conversion ratio of the sampling rate based on input prosodic information;

a process of decimating the unit waveform that undergoes the conversion of the sampling rate to the sampling rate of a synthesized speech; and a process of generating the synthesized speech using the decimated unit waveform, wherein said process of performing the conversion finds pitch frequency from said prosodic information and increases a value of said conversion ratio to a higher value in case of a higher value of the pitch frequency, wherein said process of performing the conversion finds position of pitch synchronization from said pitch frequency and uses the value of the conversion ratio which reduces an error in the position of pitch synchronization to a smaller value, wherein the error is the difference between the position of pitch synchronization as found by a pitch synchronization process and a waveform center position of the waveform as selected out of sampling-rate-converted unit waveforms.

* * * * *